US006714748B1

(12) United States Patent
Nakayasu et al.

(10) Patent No.: US 6,714,748 B1
(45) Date of Patent: Mar. 30, 2004

(54) IMAGE FORMING APPARATUS, RECORDING MEDIUM IN WHICH TEST-PATTERN IMAGE FORMING PROGRAM IS RECORDED, TEST-PATTERN IMAGE FORMING METHOD, AND SKEW ANGLE CALCULATION METHOD

(75) Inventors: Hirofumi Nakayasu, Kawasaki (JP); Susumu Imado, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/721,663

(22) Filed: Nov. 27, 2000

(30) Foreign Application Priority Data

Jan. 26, 2000 (JP) ..... 2000-017606

(51) Int. Cl.[7] ..... G03G 15/00

(52) U.S. Cl. ..... 399/72; 399/301; 399/395; 347/116

(58) Field of Search ..... 399/72, 301, 15, 399/49, 165, 395; 347/19, 116

(56) References Cited

U.S. PATENT DOCUMENTS

| | | | | | |
|---|---|---|---|---|---|
| 5,909,235 | A | * | 6/1999 | Folkins | 347/116 |
| 6,084,606 | A | * | 7/2000 | Moriyama | 347/19 |
| 6,109,722 | A | * | 8/2000 | Underwood et al. | 347/19 |
| 6,198,549 | B1 | * | 3/2001 | Decker et al. | 347/19 |
| 6,198,896 | B1 | * | 3/2001 | Nakayasu et al. | 347/116 |
| 6,219,517 | B1 | * | 4/2001 | Takahashi et al. | 399/301 |
| 6,322,191 | B1 | * | 11/2001 | Seshimo et al. | 347/19 |

FOREIGN PATENT DOCUMENTS

| | | |
|---|---|---|
| JP | 5-96715 | 4/1993 |
| JP | 6-206347 | 7/1994 |
| JP | 9-304992 | 11/1997 |
| JP | 10-115955 | 5/1998 |
| JP | 10-333398 | 12/1998 |

* cited by examiner

*Primary Examiner*—Robert Beatty
(74) *Attorney, Agent, or Firm*—Westerman, Hattori, Daniels & Adrian, LLP

(57) ABSTRACT

An image forming apparatus equipped with a first image forming unit, plural second image forming units, and a test-pattern image forming control unit for controlling the first and second image forming units which controls the first and second image forming units to form a test-pattern image, in such a manner that first and second marks of different densities are disposed adjacent to one another, based on test-pattern image data. This test-pattern image data includes first data serving to arrange a plurality of first color lines, which have each a predetermined line width, at a predetermined pitch by the first image forming unit, second data serving to form the first mark overlapping with the plural first color lines by the second image forming units, and third data serving to form the second mark displaced in a direction perpendicular to the plural first color lines. Before shipping the apparatus from a factory or when inspecting or repairing the apparatus at user's site, the customer engineer can easily grasps causes for possible positional errors using this simple test pattern and hence can cope with such trouble by exchanging or adjusting positions of parts comfortably and efficiently.

16 Claims, 14 Drawing Sheets

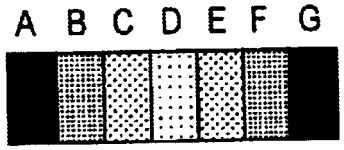

FIG.8(a) POSITIONAL DISPLACEMENT BETWEEN K - M = ± 0 DOT

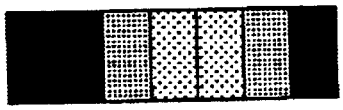

FIG.8(b) POSITIONAL DISPLACEMENT BETWEEN K - M = + 0.5 DOT

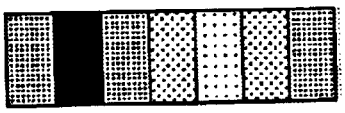

FIG.8(c) POSITIONAL DISPLACEMENT BETWEEN K - M = + 1 DOT

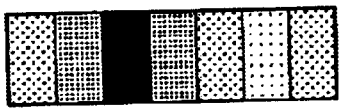

FIG.8(d) POSITIONAL DISPLACEMENT BETWEEN K - M = + 2 DOT

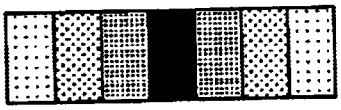

FIG.8(e) POSITIONAL DISPLACEMENT BETWEEN K - M = + 3 DOT

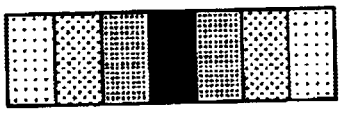

FIG.8(f) POSITIONAL DISPLACEMENT BETWEEN K - M = - 3 DOT

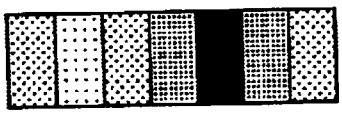

FIG.8(g) POSITIONAL DISPLACEMENT BETWEEN K - M = - 2 DOT

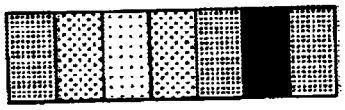

FIG.8(h) POSITIONAL DISPLACEMENT BETWEEN K - M = - 1 DOT

IMAGE FORMING APPARATUS, RECORDING MEDIUM IN WHICH TEST-PATTERN IMAGE FORMING PROGRAM IS RECORDED, TEST-PATTERN IMAGE FORMING METHOD, AND SKEW ANGLE CALCULATION METHOD

BACKGROUND OF THE INVENTION

1. Field of the Invention

The present invention relates to an image forming apparatus, which is to be used in electrophotographic machines, such as printers, copiers and facsimiles, for forming a full-color image as the individual color images formed by plural electrostatic recording unite are overlapped. Also, the invention relates to a recording medium in which a test-pattern image forming program is recorded, a test-pattern image forming method, and a skew angle calculating method.

2. Description of the Related Art

As electrophotographic color printers, a tandem type is hitherto known in which a plurality of electrostatic recording units (image forming units) are arranged in sequence in the direction of conveyance of recording paper.

The typical tandem color printer is equipped with four electrostatic recording units for four colors, i.e. black (K), cyan (C), magenta (M) and yellow (Y). Each of the four electrostatic recording units forms a latent image by optically scanning a photosensitive drum based on image data, and then develops the latent image with color toner of the individual color in a developing device. After having been developed with color toner of the individual colors on these four electrostatic recording units, the four-color toner images are transferred onto the recording paper, which is being conveyed at a constant speed, as overlapped one over another in the order of yellow (Y), magenta (M), cyan (C) and black (K). Subsequently this composite image is fixed on the recording paper by a fixing device to complete a full-color print.

For improving the quality of color print in such tandem-type color printer, it is necessary to minimize positional errors (print errors) of the toner images, which are to be transferred onto the recording paper by the individual electrostatic recording units, to increase the precision of color registration.

For example, if the solution in either of the primary scanning direction (perpendicular to the direction of conveyance of the recording paper) and the secondary scanning direction (the direction of conveyance of the recording paper) on the recording paper is 600 dpi (dots per inch), the inter-dot pitch is approximately 42 $\mu$m; the positional errors of the toner images must be limited to the pixel pitch within this range.

Consequently it has been customary to previously detect amounts of errors in a primary scanning direction, a secondary scanning direction and an oblique direction (inclined with respect to the direction of conveyance of the recording paper) and then to correct these positional errors.

As one example, image data corrected in accordance with the individual amounts of positional errors is expanded on a bitmap memory (image memory). And as another example, the timing to read out the expanded image data from the bitmap memory. As still another example, the error of position in the secondary scanning direction in particular is corrected by varying the timing of exposure by an exposure device.

For realizing effective utilization of positional error correction to restrict the positional error extents within the range of less than approximately 42 $\mu$m in pixel pitch, it is necessary to exchange parts and adjust mechanical positions with precision prior to shipping from a factory or when maintenance, inspection or repairing by a custom engineer (CE) after installation of a product printer at user's site.

For example, in the presence of a problem in accuracy of manufacture, such as when an exposure device equipped with the individual electrostatic recording unit curves in the scanning direction, when the inter-dot pitch of the exposure device is poor, or when the axis of a photosensitive drum is off the center line, it is hard to correct the positional errors. As that is the case, it would then be more important to exchange parts and adjust mechanical positions so that the positional errors can be within a predetermined allowance by the above-mentioned correction of position error amounts.

Consequently, when shipping from a factory, for example, it is necessary to grasp a cause for positional error by printing a test-pattern image to check what kind of the positional error has occurred in a printer to be shipped. Then, the position is corrected mechanically or the involved part is exchanged with a new one to provide an allowance of positional errors will cope with by the above-mentioned correction.

However, since possible positional errors with color printers include those which would occur with lapse of time, irrespective of the accuracy of manufacture of various parts, it is necessary to grasp causes of positional errors by printing a test-pattern image also at the time of maintenance, inspection and repairing by a custom engineer (CE) likewise at the time of the above-mentioned shipping at a factory and observing the positional errors. And then it is necessary to mechanically correct the positions and/or to exchange of the parts. Thus it has long been cherished to perform the necessary procedure efficiently without expert's labor.

Even if such test-pattern image is printed, it yet would take time to discriminate what kinds of causes for the positional errors. Thus, after printing a test-pattern image, the operator ensures whether a positional error or errors have occurred from the printed test-pattern image. The operator then makes positional adjustments and exchange with respect to the parts that are presumably causes for the positional errors, whereupon the operator makes a print of a test-pattern image again and ensures whether the positional adjustments have been made with precision. If the positional errors have not been corrected as this result, it has been a common practice to repeat positional adjustment and/or exchange of other parts, which would be time-consuming and need expert's labor.

One solution technology has been proposed which is accomplished by grasping the positional errors using a variety of test-pattern images and discriminating causes for the errors.

Specifically, as the test-pattern images, ① a single line is printed in black (K) and three other lines are printed in parallel to the black line in yellow (Y), magenta (M) and cyan (C), or ② the yellow (Y), magenta (M) and cyan (C) lines are printed so as to extend beyond the black (K) line, or ③ the yellow (Y), magenta (M) and cyan (C) are printed so as to cross the black (K) line to form a two-color cross mark.

In this conventional technology, since the test-pattern image printed for grasping the positional errors has to identified using a microscope or a magnifying glass, it is very meticulous so that efficient jobs would hardly been achieved.

As an alternative solution, Japanese Patent Laid-Open Publication No. HEI 9-304992 discloses a technology in which a test-pattern image composed of longitudinal or transverse lines are printed in fragments on recording paper, and printing errors in the primary, secondary and oblique scanning directions are detected for information enabling the operator to make adjustments without difficulty.

According to this conventional technology, although the extent of a positional error can be recognized by eyes, it is impossible to grasp a continuous change of the positional error as the test-pattern image is arranged only in fragments on recording-paper. Further, when non-uniform printing occurs due to the difference in extent of positional error between local positions of the recording paper, it is impossible to grasp the cycle and amplitude of the non-uniformity of printing. As a result, it is difficult to judge the cause for the positional error exactly.

As still another alternative solution, Japanese Patent Laid-Open Publication No. HEI 10-115955 discloses a technology which comprises previously providing a memory with a test-pattern image composed of plural groups of lines extending parallel to the primary scanning direction, printing an overlapped test-pattern image of a reference color (magenta, for example) and another color (yellow, for example), and estimating a positional error due to the inclination with respect to the primary scanning direction in terms of moire stripes that inevitably occur with the positional error due to the inclination (oblique print divergence, or skew) with respect to the lines extending in the primary scanning direction.

In this conventional technology, however, although the skew angle can be measured only in accordance with the number of moiré stripes, it is difficult to grasp the cause for the positional error in the presence of a curvature in the scanning direction or if the inter-dot pitch accuracy is poor. It is also difficult to grasp the direction of skew, namely, whether the positional error due to the inclination of lines, which extend in the primary scanning direction, with respect to the secondary scanning direction is a rising-on-the-right positional error or a rising-on-the-left positional error.

SUMMARY OF THE INVENTION

With the foregoing problems in view, it is a first object of the present invention to provide an image forming apparatus which enables exchange and positional adjustment of parts quickly and efficiently by easily grasping causes for possible positional errors using a simple test pattern, in maintenance, inspection and repairing of the apparatus by a custom engineer (CE) before shipping from a factory or after installation at the user's site.

A second object of the invention is to provide a recording medium in which a test-pattern forming program is stored for use in printing a test-pattern image on the image forming apparatus for the above-mentioned purpose.

A third object of the invention is to provide a method for printing the test-pattern image on the image forming apparatus for the above-mentioned purpose.

A fourth object of the invention is to provide a method for calculating a skew angle (positional error) using the test-pattern image as printed on the image forming apparatus for the above-mentioned purpose.

According to a first generic feature of the present invention, there is provided an image forming apparatus comprising: a plurality of image forming units for forming different color images on recording paper, the plural image forming units including a first color image forming unit for forming a first color image, and at least one second color image forming unit for forming a second color image; and test-pattern image forming control means for controlling the first and second image forming units to form a test-pattern image composed of first and second marks different in density, which are arranged adjacent to one another, based on test-pattern image data that includes first data serving to arrange a plurality of first color lines, each having a predetermined line width, at a predetermined pitch by the first color image forming unit, second data serving to form the first mark by arranging a plurality of second color lines, each having a line width equal to that of the individual first color line, at a pitch equal to that of the first color lines by the at least one second color image forming unit so as to overlap with the first color lines within a first region occupying part of one area where of the plural first color lines are arranged, and third data serving to form the second mark by displacing a plurality of second color lines in a direction perpendicular to the first color lines within a second region contiguous to the first region and by arranging the second color lines, each having a line width equal to that of the individual first color line, at a pitch equal to that of the first color lines by the at least one second color image forming unit.

With this image forming apparatus, it is possible to form a test-pattern image with a simple construction and also to recognize a positional error easily by eyes, facilitating maintenance, inspection, repairing by the customer engineer at user's site or inspection before shipping the apparatus from a factory.

As a preferable feature: the second region is composed of a plurality of sub-regions; the third data is data serving to form a plurality of second marks, which are different in density from one another, by varying the extent of displacement of the second color lines from the first color lines in the plural sub-regions of the second region stepwise; and the test-pattern image forming control means controls the first and second image forming units to form the test-pattern image such that the first mark and the plural second marks are disposed adjacent to one another as they are different in density from one another.

With this preferable feature, partly since the second region is divided into a plurality of sub-regions, and partly since a plurality of second marks different in density are formed by arranging the second color lines in the sub-regions with varying the extents of displacement with respect to the first color lines stepwise, it is possible to recognize the positional error more easily.

As another preferable feature: the predetermined line width is equal to the size of a single dot; the second region is composed of a plurality of sub-regions; the third data is data serving to form a plurality of second marks of different densities by varying the extent of displacement of the second color lines from the first color lines in the plural sub-regions of the second region stepwise by one dot for every sub-region; and the test-pattern image forming control means controls the first and second image forming units to form the test-pattern image such that the first mark and the plural second marks are disposed adjacent to one another as they are different in density from one another.

With this second preferable feature, partly since each of the first and second color lines has a predetermined line width corresponding to the size of a single dot, and partly. since the second marks different in density are formed in the plural sub-regions of the second region by arranging the second color liens with varying the extents of displacement with respect to the black lines stepwise by one dot for every sub-region, it is possible to judge a positional error in the order of 1 dot easily by eyes.

As still another preferable feature: the first image forming unit is a black-dedicated image forming unit for forming black lines as the first color lines; the at least one second image forming unit includes a magenta-dedicated image forming unit for forming magenta lines as the second color lines, a cyan-dedicated image forming unit for forming cyan lines as the second color lines, and a yellow-dedicated image forming unit for forming yellow lines as the second color lines; and the test-pattern image forming control means controls the black-, magenta-, cyan- and yellow-dedicated image forming units in such a manner that at least one of a cyan test-pattern image of the black and cyan lines, a magenta test-pattern image of the black and magenta lines, and a yellow test-pattern image of the black and yellow lines, is formed as the test-pattern image.

With the third preferable feature, by forming only the test-pattern image needed for grasping the occurrence of a positional error, it is possible to recognize the positional error efficiently. Further, since the test-pattern image is formed with selecting black, which is most contractive, as a reference color, it is possible to recognize a positional error more easily.

As a further preferable feature: each of the first and second color lines is a transverse line extending in a primary scanning direction perpendicular to a direction of conveyance of the recording paper; and the test-pattern image composed of the first and second marks contains a longitudinal succession of portions of the plural first color lines extending longitudinally and is formed on the recording paper at at least scanning-start- and scanning-end-side marginal regions in a secondary scanning direction perpendicular to the primary scanning direction.

With this fourth preferable feature, since the test-pattern image is formed in the above-mentioned manner, it is possible to realize the following judgments, using this test-pattern image when the printer is shipped from a factory or when the custom engineer repairs or inspects the printer in user's site. It is accordingly possible to grasp a change in the secondary scanning direction in extent of positional error in the secondary scanning direction by observing this test-pattern image by eyes, thereby discriminating whether or not there have occurred any change of rotational speed of the individual photosensitive drum or any change of feed speed of recording paper (print sheet), which can be assumed as a cause for the change in the secondary scanning direction in extent of positional error in the secondary scanning direction (uneven printing in the secondary scanning direction).

As an additional preferable feature: each of the first and second color lines is a transverse line extending in a primary scanning direction perpendicular to a direction of conveyance of the recording paper; and the test-pattern image composed of the first and second marks contains a longitudinal succession of portions of the plural first color lines and is formed on the recording paper continuously from a scanning-start-side marginal region to a scanning-end-side marginal region in a secondary scanning direction perpendicular to the primary scanning direction.

With this fifth preferable feature, since the test-pattern image is formed on the recording paper continuously from the scanning-start-side to the scanning-end-side in the secondary scanning direction, it is possible to recognize a change in the second scanning direction in positional error extent in the secondary scanning direction more precisely.

As another preferable feature: each of the plural image forming units is an electrostatic recording unit equipped with a photosensitive drum; each of the first and second color lines is a transverse line extending in a primary scanning direction perpendicular to a direction of conveyance of the recording paper; and the test-pattern image composed of the first and second marks contains a longitudinal succession of portions of the plural first color lines and is formed on the recording paper so as to extend longitudinally by a length longer than a circumferential length of the photosensitive drum associated with the respective one of the first and second image forming units.

With this sixth preferable feature, since the test-pattern image is formed so as to extend in the secondary scanning direction by a length larger than the circumferential length of the photosensitive drum associated with a respective one of the first and second image forming units, it is possible to recognize precisely a change of rotational speed of the photosensitive drum which change would presumably be a cause for the change in the secondary scanning direction in the positional error extent in the secondary scanning direction.

As still another preferable feature: each of the first and second color lines is a longitudinal line extending in a direction of conveyance of the recording paper; and the test-pattern image composed of the first and second marks contains a transverse succession of portions of the plural first color lines extending longitudinally and is formed on the recording paper at at least scanning-start- and scanning-end-side marginal regions in the primary scanning direction.

With this seventh preferable feature, by observing the test-pattern image, which is image forming apparatus and the modified test-pattern image forming method of the second embodiment, it is possible to judge a change in the primary scanning direction in the positional error extent in the primary scanning direction precisely in terms of the positional error in the secondary scanning direction of the individual mark as the test-pattern image with the second color lines TL2 displaced in the primary scanning direction is observed by eyes for shipment of the printer at a factory or for maintenance, inspection or repairing of the printer at user's site by the customer engineer. As a result, it is possible to grasp a change in the primary scanning direction in extent of positional error in the primary scanning direction so that the customer engineer can discriminate whether or not there have occurred a staggering the primary scanning direction, it is possible to judge a change pitch of the exposure device or an positioning error of the exposure device, which can be assumed as a cause for the change in the primary scanning direction in extent of positional error in the primary scanning direction (uneven printing in the primary scanning direction). Then the customer engineer performs exchange of parts and mechanical adjustments of positions of parts exactly and efficiently.

As a further preferable feature: each of the first and second color lines is a longitudinal line extending in a direction of conveyance of the recording paper; and the test-pattern image composed of the first and second marks contains a transverse succession of portions of the plural first color lines extending longitudinally and is formed on the recording paper continuously from a scanning-start-side marginal region to a scanning-end-side marginal region in the primary scanning direction.

With this eighth preferable feature, by forming the test-pattern image on the recording paper continuously from the scanning-start-side to the scanning-end-side in the primary scanning direction perpendicular to the recording paper conveyance direction, it is possible to recognize a change in the primary scanning direction in positional error in the primary scanning direction with increased accuracy.

As an additional preferable feature: each of the first and second color lines is a longitudinal line extending in a direction of conveyance of the recording paper; and the test-pattern image composed of the first and second marks contains a transverse succession of portions of the plural first color lines extending longitudinally and is formed on the recording paper continuously from a scanning-start-side marginal region to a scanning-end-side marginal region in the secondary scanning direction.

With this ninth preferable feature, by observing the test-pattern image, which is formed with the second color lines displaced in the primary scanning direction, by eyes, it is possible to judge a change in the secondary scanning direction in positional error extent in the primary scanning direction in terms of positional error of the individual marks in the primary scanning direction. As the result, it is possible to grasp a change in the secondary scanning direction in extent of positional error in the primary scanning direction so that the customer engineer can discriminate whether or not there have occurred a staggering movement of the conveyor belt or an inclined posture of the drive-gear-attachment flange associated with the photosensitive drum, which would presumably a cause for the change in the secondary scanning direction (uneven printing in the secondary scanning direction) in positional error extent in the primary scanning direction. And the customer engineer can perform exchange of parts and mechanical adjustments of positions of parts exactly and efficiently.

As another additional preferable feature: each of the plural image forming units is an electrostatic recording unit equipped with a photosensitive drum; each of the first and second color lines is a longitudinal line-extending in a direction of conveyance of the recording paper; and the test-pattern image composed of the first and second marks contains a transverse succession of portions of the plural first color lines extending longitudinally and is formed so as to extend longitudinally by a length longer than a circumferential length of the photosensitive drum associated with the respective one of the first and second image forming nits.

With this tenth preferable feature, since the test-pattern image is formed so as to extend in the secondary scanning direction longer than the circumferential length of the photosensitive drum associated with a respective one of the first and second image forming units, it is possible to surely recognize the occurrence of inclination of the drive-gear-attachment flange of the photosensitive drum, which inclination would presumably be a cause for the change in the secondary scanning direction in positional error extent in the primary scanning direction.

As a further preferable feature: the first image forming unit is a black-dedicated image forming unit for forming black lines as the first color lines; the at least one second image forming unit is composed of a magenta-dedicated image forming unit for forming magenta lines as the second color lines, a cyan-dedicated image forming unit for forming cyan lines as the second color lines, and a yellow-dedicated image forming unit for forming yellow lines as the second color lines; and the test-pattern image forming control means controls the black-, magenta-, cyan- and yellow-dedicated image forming units in such a manner that a cyan test-pattern image of the black and cyan lines, a magenta test-pattern image of the black and magenta lines, and a yellow test-pattern image of the black and yellow lines, are formed in a series arrangement in the primary scanning direction as a single test-pattern image combination.

With this eleventh preferable feature, since black, which is most contrastive with the whole recording paper, is selected as a reference color of the test-pattern image, the customer engineer can grasps the positional error more easily.

As a still further preferable feature: each of the first and second color lines is a transverse line extending in a primary scanning direction perpendicular to a direction of conveyance of the recording paper; and the test-pattern image composed of the first and second marks contains a longitudinal succession of portions of the plural first color lines extending transversely and is formed on the recording paper continuously from a scanning-start-side marginal region to a scanning-end-side marginal region in the primary scanning direction.

With this twelfth preferable feature, by observing the test-pattern image, which is formed with the second color lines displaced in the secondary scanning direction, by eyes, the customer engineer can recognize a change in the primary scanning direction in positional error extent in the secondary scanning direction in terms of the positional error of the individual marks in the secondary scanning direction. As the result, it is possible to grasp a change in the primary scanning direction in extent of positional error in the secondary scanning direction so that the customer engineer can discriminate whether or not there have occurred non-parallel or curved scanning lines of the exposure device, which would presumably a cause for the change in the primary scanning direction in extent of positional error in the secondary scanning direction. And the customer engineer can perform exchange of parts and mechanical adjustments of positions of parts exactly and efficiently.

As another preferable feature: each of the first and second color lines is a transverse line extending in a primary scanning direction perpendicular to a direction of conveyance of the recording paper; and the test-pattern image composed of the first and second marks contains a longitudinal succession of portions of the plural first color lines extending transversely and is formed continuously from a scanning-start-side marginal region to a scanning-end-side marginal region in the primary scanning direction.

With this thirteenth preferable feature, since the test-pattern image is formed on the recording paper continuously from the scanning-start-side to the scanning-end-side in the primary scanning direction perpendicular to the recording paper conveyance direction, it is possible to recognize a change in the primary scanning direction in positional error in the secondary scanning direction with increased accuracy.

As still another preferable feature: the first image forming unit is a black-dedicated image forming unit for forming black lines as the first color lines; the at least one second image forming unit is composed of a magenta-dedicated image forming unit for forming magenta lines as the second color lines, a cyan-dedicated image-forming unit for forming cyan lines as the second color lines, and a yellow-dedicated image forming unit for forming yellow lines as the second color lines; and the test-pattern image forming control means controls the black-, magenta-, cyan- and yellow-dedicated image forming units in such a manner that a cyan test-pattern image of the black and cyan lines, a magenta test-pattern image of the black and magenta lines, and a yellow test-pattern image of the black and yellow lines, are formed in a series arrangement in the secondary scanning direction as a single test-pattern image combination.

With this fourteenth preferable feature, it is possible to recognize a positional error for every color efficiently.

Further, since the test-pattern image is formed with black, which is most contrastive color, as a reference color, the customer engineer can recognize the positional error more easily.

As an additional preferable feature, the test-pattern image is a composite form of a plurality of pattern images to be formed on a single sheet of the recording paper, the plural pattern images including: a first pattern image in which each of the first and second color lines is a transverse line extending in a primary scanning direction perpendicular to the direction of conveyance of the recording paper, the first pattern image being composed of the first and second marks, containing a longitudinal succession of portions of the plural first color lines and being formed on the recording paper at at least a scanning-start-side marginal region and a scanning-end-side marginal region in a secondary scanning direction perpendicular to the primary scanning direction; a second pattern image in which each of the first and second color lines is a longitudinal line extending in the direction of conveyance of the recording paper, the second pattern image being composed of the first and second marks, containing a transverse succession of portions of the plural first color lines and being formed on the recording paper at at least a scanning-start-side marginal region and a scanning-end-side marginal region in the primary scanning direction; and a third pattern image in which each of the first and second color lines is a longitudinal line extending in the direction of conveyance of the recording paper, the third pattern image being composed of the first and second marks, containing a transverse succession of portions of the plural first color lines and being formed on the recording paper continuously from a scanning-start-side marginal region to a scanning-end-side marginal region in the secondary scanning direction.

With this fifteenth preferable feature, given that a plurality of test-pattern images are collectively printed on a single sheet of recording paper, the customer engineer can concurrently judge more than one cause for positional errors when shipping the printer from a factory or when repairing and inspection of the printer at user's site. For the same reason, it is possible to judge more than one cause for position errors efficiently, without spending recording paper and toner more than necessary.

According to a second generic feature of the present invention, there is provided a recording medium in which a test-pattern image forming program, for instructing a computer to control a plurality of image forming units so as to form of a test-pattern image of different color images on recording paper, is stored, wherein the program instructs the computer to function as control means for controlling the first and second image forming units based on test-pattern image data that includes: first data serving to arrange a plurality of first color lines, each having a predetermined line width, at a predetermined pitch by a first color image forming unit of the plural color image forming units; second data serving to form the first mark by arranging a plurality of second color lines, each having a line width equal to that of the individual first color line, at a pitch equal to that of the first color lines by at least one second color image forming unit of the plural color image forming units so as to overlap with the first color lines within a first region occupying part of an area where the plural first color lines are arranged; and third data serving to form the second mark by displacing a plurality of second color lines in a direction perpendicular to the first color lines within a second region contiguous to the first region and by arranging the second color lines, each having a line width equal to that of the individual first color line, at a pitch equal to that of the first color lines by the at least one second color image forming unit.

With this test-pattern image forming program storing recording medium, by installing the above-mentioned test-pattern image forming program and test-pattern data from the recording medium before shipping the apparatus from a factory or when maintenance, inspection or repairing of the apparatus at user's site, the customer engineer can form the test-pattern image in a simple fashion and hence recognize a positional error by eyes even if the image storage device of the apparatus does not previously have the program and the test-pattern data.

According to a third generic feature of the present invention, there is provided a test-pattern image forming method comprising the steps of: creating test-pattern image data that includes first data serving to arrange a plurality of first color lines, each having a predetermined line width, at a predetermined pitch, second data serving to form the first mark by arranging a plurality of second color lines, each having a line width equal to that of the individual first color line, at a pitch equal to that of the first color lines so as to overlap with the first color lines within a first region occupying part of an area where the plural first color lines are arranged, and third data serving to form the second mark by displacing a plurality of second color lines in a direction perpendicular to the first color lines within a second region contiguous to the first region and by arranging the second color lines, each having a line width equal to that of the individual first color line, at a pitch equal to that of the first color lines; forming a test-pattern image, which is composed of the first and second marks of different densities, by forming the first mark such that the second color lines overlap with the first color lines, based on the first and second data, and by forming the second mark in such a manner that the second color lines are displaced from the first color lines and are disposed adjacent thereto, based on the first, second and third data.

According to the test-pattern image forming method of the present invention, it is possible form the above-mentioned test-pattern image in a simple manner and also to recognize a positional error easily by eyes before shipping the apparatus from a factory or when maintenance, inspection or repairing by the customer engineer at user's site.

According to a fourth generic feature of the present invention, there is provided a skew angle calculation method comprising the steps of: forming a test-pattern image composed of first and second marks different in density, which are arranged adjacent to one another, the first mark being formed by arranging a plurality of first color lines, each having a predetermined line width, at a predetermined pitch, and arranging a plurality of second color lines, each having a line width equal to that of the individual first color line, at a pitch equal to that of the first color lines so as to overlap with the first color lines within a first region occupying part of an area where the plural first color lines are arranged, the second mark being formed by displacing a plurality of second color lines in a direction perpendicular to the first color lines within a second region contiguous to the first region, and by arranging the second color lines, each having a line width equal to that of the individual first color line, at a pitch equal to that of the first color lines, the first and second marks being formed on the recording paper at at least a scanning-start-side marginal region and a scanning-end-side marginal region in a primary scanning direction perpendicular to the direction of conveyance of the recording paper; and calculating a skew angle using the extents of displacement of the individual test-pattern images.

According to the skew angle calculation method of the present invention, it is possible to calculate a skew angle easily using the test-pattern images that are formed in a simple fashion and in different densities.

BRIEF DESCRIPTION OF THE DRAWINGS

FIG. 8, (a) through (h), is a diagram illustrating how to discriminate various extents of positional displacement in terms of a test-pattern image printed by the image forming apparatus of the first embodiment;

DESCRIPTION OF THE PREFERRED EMBODIMENTS

Preferred embodiments of the present invention will now be described with reference to the accompanying drawings. Like reference numbers and/or characters designate similar parts or elements throughout several views.

First of all, an image forming apparatus, a test-pattern image forming apparatus and a skew angle calculation method according to a first embodiment of the present invention will now be described with reference to the accompanying drawings.

The image forming apparatus is applied to printing machines, such as electrophotographic printer, copying machine and facsimile machine. Here an example in which the image forming apparatus is applied to an electrophotographic, full-color printer (hereinafter also called the full-color printer) is described.

Figure 2:
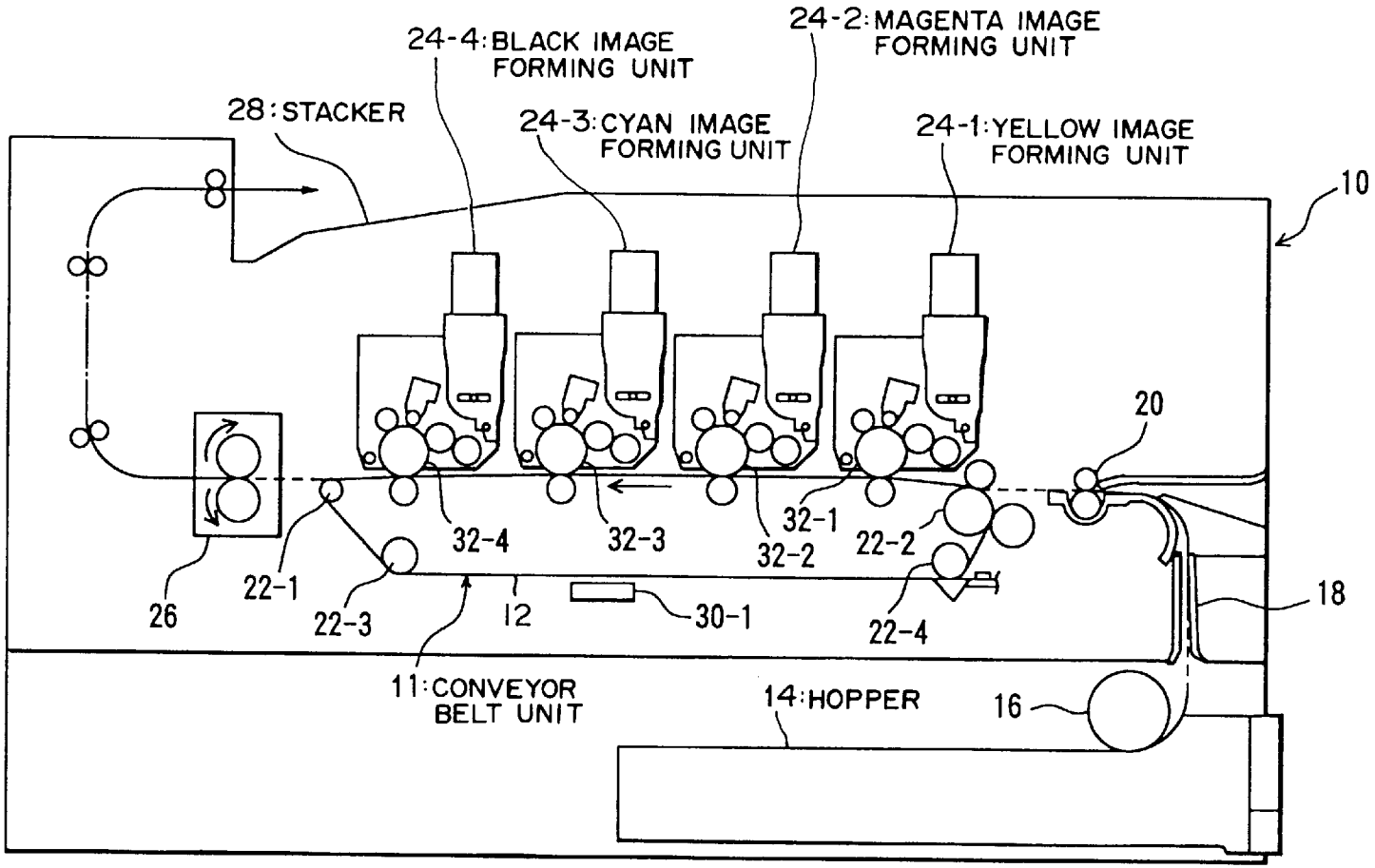
FIG. 2 is a diagram schematically showing the interior structure of the image forming apparatus of the first embodiment.

The full-color printer, as schematically shown in FIG. 2, comprises a conveyor belt unit 11 for conveying the recording paper, a plurality of (four) electrostatic recording units (hereinafter also called the image forming units) 24-1 through 24-4, and a hopper 14 in which a stack of sheets of recording paper is stored for delivery. These parts are detachably mounted in a housing 10 of the full-color printer.

The conveyor belt unit 11 includes a plurality of (four) rollers 22-1 through 22-4, and an endless belt 12 made of transparent dielectric material, such as synthetic resin material, and wound around the plural rollers 22-1 through 22-4.

Of the four rollers 22-1 through 22-4, one roller 22-1 is a driven roller. The driven roller 22-1 is operatively connected to a belt drive motor via a drive mechanism, such as a non-illustrated gear train, for moving the endless belt 12 in an anticlockwise direction, as indicated by an arrow, at a constant speed. Further, the driven roller 22-1 serves also as an A.C. de-electrifier roller for removing electrical charges from the endless belt 12.

Another roller 22-2 is a follower roller serving an electrifier roller for charging the endless belt 12 with electricity.

The remaining rollers 22-3, 22-4 are guide rollers disposed adjacent to the driven roller 22-1 and the follower roller 22-2.

And a path of conveyance (moving) of the recording paper is defined on the upper side of the endless belt 12 traveling between the driven roller 22-1 and the follower roller 22-2.

In the full-color printer thus constructed, a stack of sheets of recording paper in the hopper 14 is paid out one sheet after another from the top of the stack by the action of a pickup roller 16. Then the individual sheet of recording paper (hereinafter also called the recording paper) is introduced into the recording paper conveyance path, defined over the endless belt 12, from the side of the follower roller 22-2 via a guide path 18 by the action of a pair of delivery rollers (hereinafter also called the registration rollers) 20. Having passed the recording paper conveyance path, the recording paper having passed is discharged off the endless belt 12 from the side of the driven roller 22-1.

Because the endless belt 12 is charged with electricity by the follower roller 22-2, the recording paper is electrostatically attracted to the endless belt 12 when introduced to the recording paper conveyance path from the side of the follower roller 22-2, so that a possible positional error of the recording paper being moved is prevented.

Meanwhile, because the driven roller 22-1 on the recording paper discharge side serves as a de-electrifier roller, charges are removed off the endless belt 12 at a portion contacting the driven roller 22-1. As a result, charges are removed off the recording paper when the recording paper passes the driven roller 22-1, so that the recording paper is easily peeled off the endless belt 12, for discharge out of the full-color printer, without being wound under the endless belt 12 by accident.

Inside the housing 10 of the full-color printer, as shown in FIG. 2, as a plurality of image forming units for forming images of different colors on the recording paper, four electrostatic recording units 24-1, 24-2, 24-3, 24-4 respectively dedicated to yellow (Y), magenta (M), cyan (C) and black (K) are mounted.

These four electrostatic recording units 24-1 through 24-4 are arranged on the upper side of the endless belt 12 so as to face the upper surface of the endless belt 12 moving between the follow roller 22-2 and the driven roller 22-1. And these electrostatic recording units 24-1 through 24-4 have a tandem structure in which they are arranged in series in the order of yellow (Y), magenta (M), cyan (C) and black (K) from the upstream side toward the downstream side along the recording paper conveyance path.

The four electrostatic recording units 24-1 through 24-4 are different from one another in using a yellow toner ingredient (Y), a magenta toner ingredient (M), a cyan toner ingredient (C) and a black toner ingredient (K), respectively, as a developer, being identical in the other structure with one another. Each electrostatic recording unit 24-1 through 24-4 is composed of a light source, an exposure unit for forming a corresponding latent image on the associated photosensitive drum 32-1 through 32-4, and a developing unit for forming a corresponding toner image on the associated photosensitive drum 32-1 through 32-4. In particular, toner in the developing unit may alternatively be contained in an independently exchangeable toner cartridge.

Figure 3:
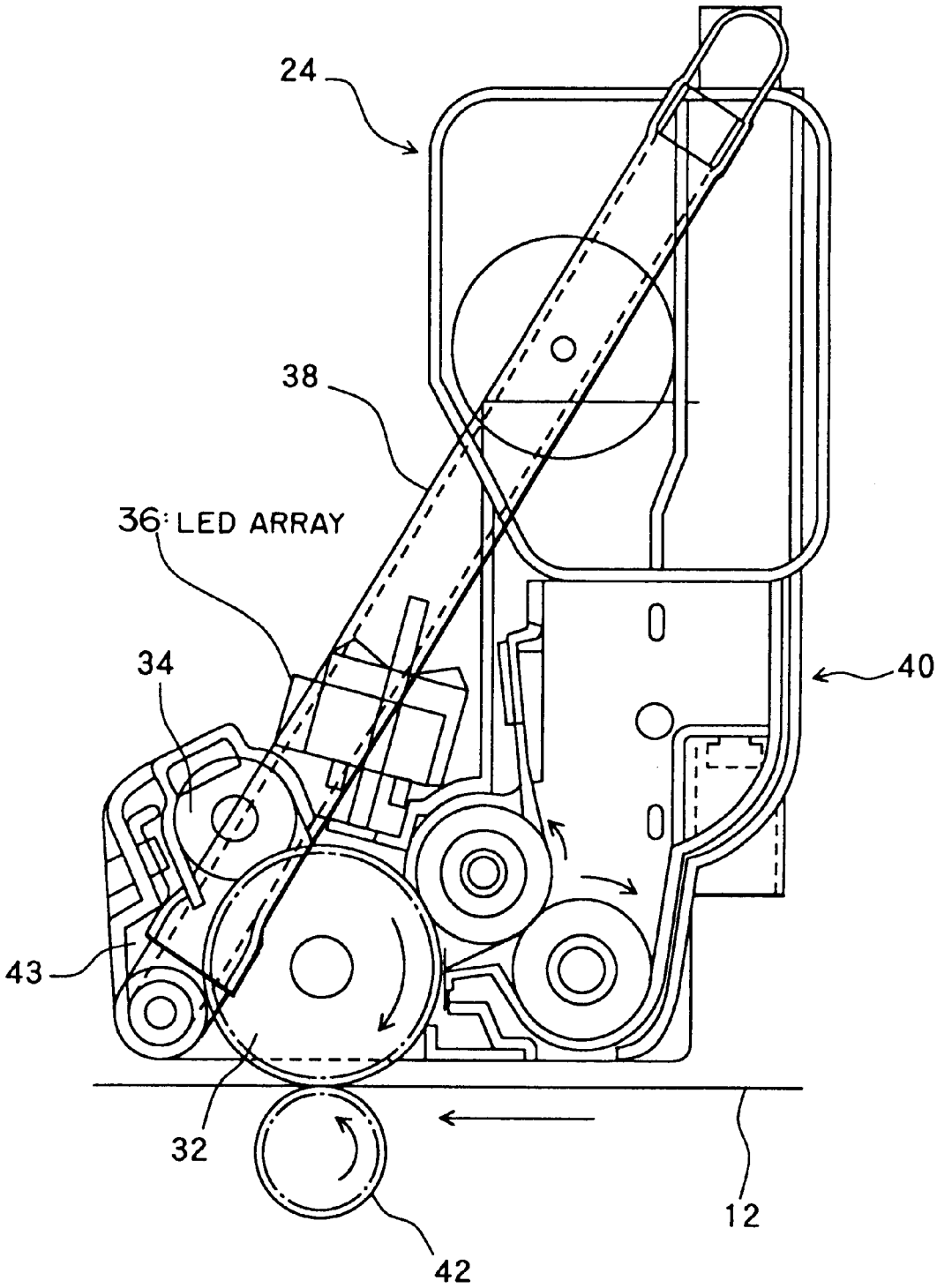
FIG. 3 is a schematic cross-sectional view of an electrostatic recording unit of the image forming apparatus of the first embodiment.

FIG. 3 is a detail view of one of the individual electrostatic recording units 24 (24-1 through 24-4) of FIG. 2.

As shown in FIG. 3, the individual electrostatic recording unit 24 (24-1 through 24-4) is equipped with the associated photosensitive drum 32 (32-1 through 32-4). Duration the recording operation, the individual photosensitive drum 32-1 through 32-4 is operatively connected to a non-illustrated drum motor via a non-illustrated gear rain so as to be driven for clockwise rotation at a constant speed.

Upwardly of the individual photosensitive drum 32, a pre-charger 34, e.g. in the form of a corona charger or a scorotron charger, is disposed in such amanner that the surface of the photosensitive drum 32 is uniformly charged by the pre-charger 34.

In the thus charged region of the photosensitive drum 32, a latent image, i.e. apattern devoid of any electric charge, is written by light emitted when a light-emitting diode (LED) array 36 serving as an optical write unit (exposure device and light source) scans. Specifically, light-emitting devices arranged in the primary scanning direction of the LED array 36 are energized, based on gradation values of pixel data (dot data) that are expanded from image data to be provided from a computer or a word processor as printing information, so that an electrostatic latent image is written in the charged region of the photosensitive drum 32 as a dot image. The term "primary scanning direction" means the direction in which the exposure device scans (direction perpendicular to the direction of conveyance of the recording paper), i.e., a transverse direction in the actual or practical printer. And the term "secondary scanning direction" means a direction perpendicular to the primary scanning direction (direction of conveyance of the recording paper), i.e., a longitudinal direction in the actual or practical printer.

The electrostatic latent image on the photosensitive drum 32 is then electrostatically developed as a charged toner image of a respective color toner by a developing device 40, which also is disposed upwardly of the photosensitive drum 32. The charged toner image on the photosensitive drum 32 is electrostatically transferred onto the recording paper by an electrically conductive transfer roller 42, which is disposed downwardly of the photosensitive drum 32. Specifically, the electrostatic transfer roller 42 confronts the photosensitive drum 32 with a small gap, which is defined by the endless belt 12, and gives electric charges of a polarity opposite to the charged toner image to the recording paper being conveyed by the endless belt 12, so that the charged toner image on the photosensitive drum 32 is electrostatically transferred onto the recording paper.

As the result of the above-mentioned transfer process, residual toner failed to be transferred to the recording paper adheres remains fixed to the surface of the photosensitive drum 32. The residual toner is removed off the photosensitive drum 32 by a toner cleaner 43 disposed downstream of the photosensitive drum 32 in the recording paper conveyance path. The removed residual toner is then returned to the developing device 40 by a screw conveyor 38 for reuse as developer toner.

Turning back to FIG. 2, as the recording paper passes through the recording paper conveyance path between the follower roller 22-2 and the driven roller 22-1 of the endless belt 12, toner image of four colors, i.e. a yellow toner image, a magenta toner image, cyan toner image and a blacktoner image, are transferred and overlapped one over another in the described sequence to form a full-color toner image. Then the recording paper is fed from the side of the driven roller 22-1 toward a thermal-fixing device 26, in the form of a heat roller, where the full-color toner image is thermally fixed to the recording paper. The resulting recording paper passes through guide rollers and is finally fed to a stacker 28, which is disposed at an upper portion of the housing 10, as a new top one of, the existing stack of printed sheets.

Further, a pair of sensors 30-1, 30-2 are disposed so as to confront the belt surface at the under side of the endless belt 12, being spaced from each other in a direction perpendicular to the belt traveling direction. In FIG. 2, only one sensor 30-1 appears in view. These two sensors 30-1, 30-2 serve to assist in optically reading out a registration mark transferred onto the endless belt 12 for the purpose of position error detection.

Figure 4:
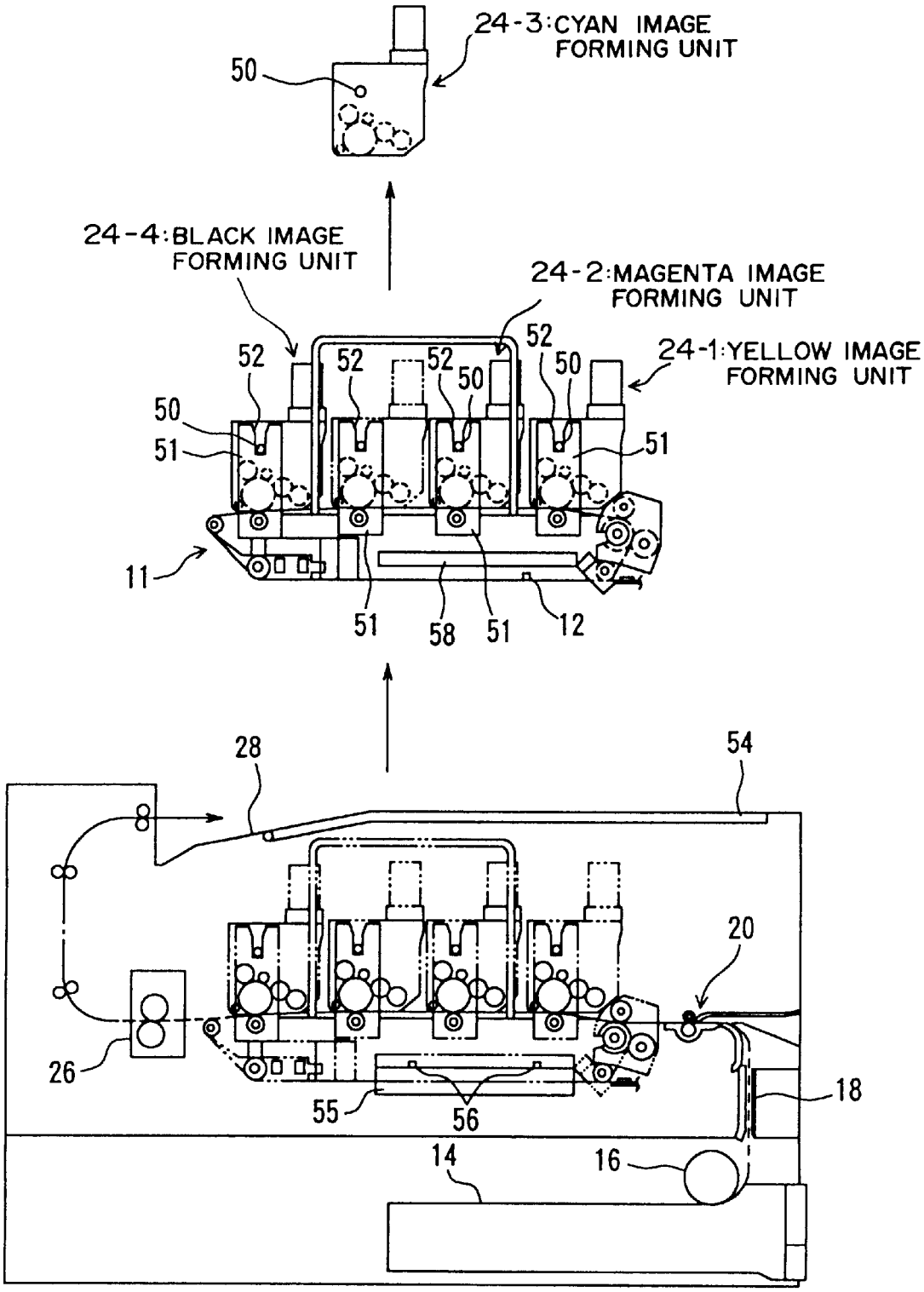
FIG. 4 is an exploded diagram showing the image forming apparatus of the first embodiment, with a conveyor belt unit and the electrostatic recording unit being removed.

FIG. 4 illustrates the manner in which the conveyor belt unit 11 is removed out of the housing of FIG. 2, and also the manner in which the individual electrostatic recording unit 24-1 through 24-4 is detachable off the conveyor belt unit 11.

At the upper portion of the housing 10, a closure 54 is mounted so as to be pivotable about one end (stacker side). Inside the housing 10, a housing-side frame 55 is mounted with two pins projecting from an upper portion of the housing-side frame 55.

In the meantime, on a side surface of the conveyor belt unit 11 as removed out of the housing 10, a unit-side frame 58 as a companion frame with the housing-side frame 55 is mounted, having two pin holes for receiving the respective pins 56 of the housing-side frame 58. With this structure, by pulling up the conveyor belt unit 11 with the closure 54 being opened, it is possible to remove the conveyor belt unit 11 off the pins 56 of the housing-side frame 55.

The individual electrostatic recording unit 24-1 through 24-4 thus carried by the conveyor belt unit 11 is attached to the conveyor belt unit 11 as an attachment pin 50 projecting from the side surface of the electrostatic recording unit 24-1 through 24-4 is fitted in a pair of corresponding attachment grooves 52, which are formed in the respective upper portions of a pair of attachment side plates 51 of the individual electrostatic recording unit 24-1 through 24-4.

Each attachment groove 52 has a composite form having an upwardly diverging V-shaped upper groove part, and a uniform-width lower groove part that is contiguous to the upper groove part and has a width substantially equal to the diameter of the attachment pin 50. By forcing the attachment pin 50 down to the bottom of the attachment groove 52, it is possible to position the individual electrostatic recording unit 24-1 through 24-4 precisely with respect to the conveyor belt unit 11. Further, for supplementing toner to or maintenance of the individual electrostatic recording unit 24-1 through 24-4, the individual electrostatic recording unit 24-3, for example, is pulled upwardly to remove with ease.

The hardware structure and function of the image forming apparatus according to the foregoing embodiment will now be described.

Figure 5:
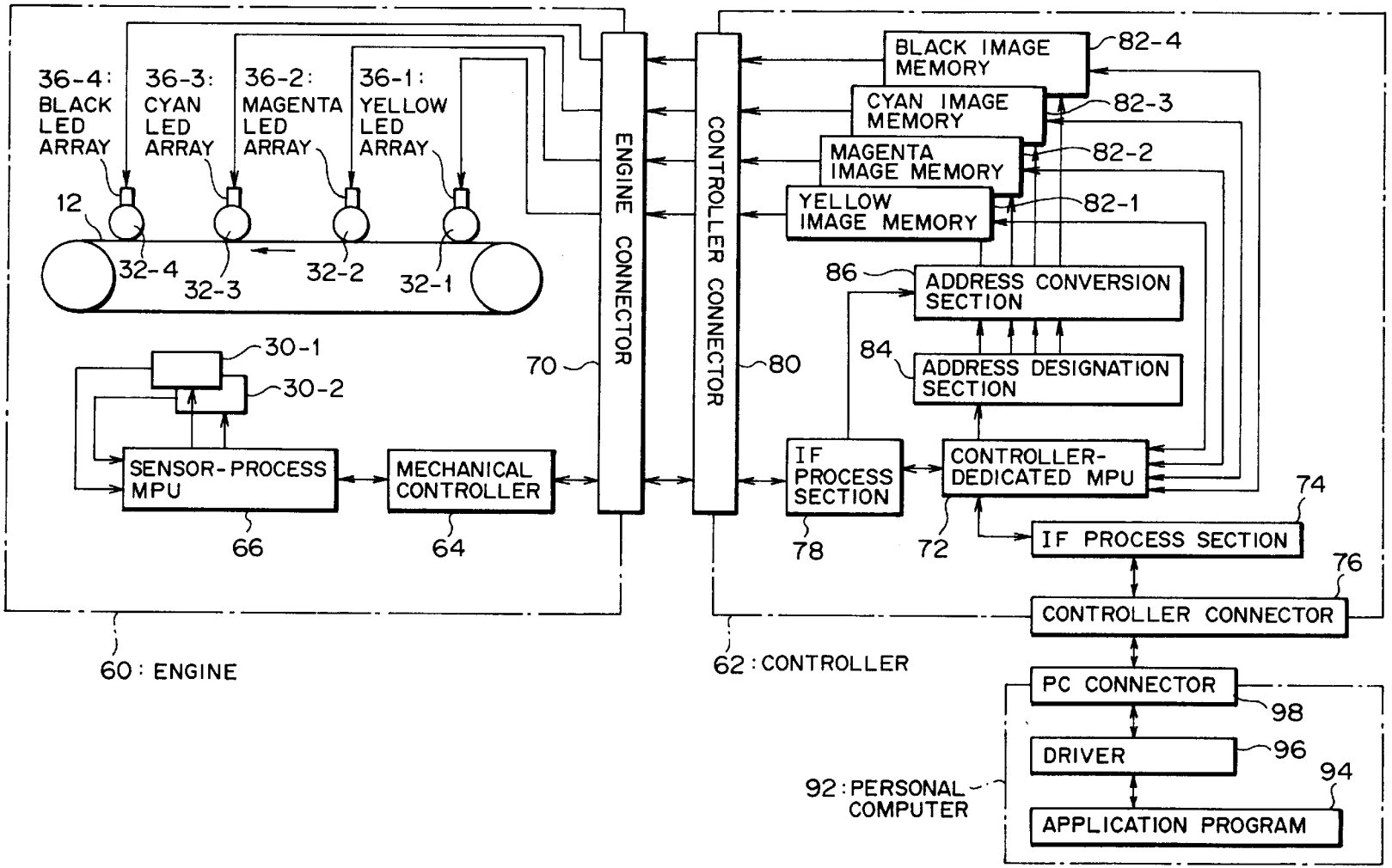
FIG. 5 is a block diagram showing the hardware structure of the image forming apparatus of the first embodiment.

FIG. 5 is a block diagram of the hardware structure of the image forming apparatus. This image forming apparatus, as shown in FIG. 5, comprises an engine 60 and a controller 62.

The engine 60 is composed of the conveyor belt unit 11 of FIG. 2, and a mechanical controller 64 for controlling a printing mechanism, such as the individual electrostatic recording units 24-1 through 24-4 of FIG. 2.

The mechanical controller 64 is connected to the controller 62 via an engine connector. As the printing mechanism mounted inside the engine 60, in FIG. 5, only the endless belt 12, the LED arrays 36-1, 36-2, 36-3, 36-4 mounted on the individual electrostatic recording units 24-1 through 24-4, and the photosensitive drums 32-1 through 32-4 are shown for convenience to describe.

To the mechanical controller 64, a sensor-process-dedicated microprocessor unit (MPU) 66 is connected for executing a positional-error correction process. To the sensor-process-dedicated MPU 66, detection signals are input from the pair of sensors 30-1, 30-2 disposed under the endless belt 12.

The controller 62 is equipped with a controller-dedicated microprocessor unit (MPU) 72. The controller-dedicated MPU 72 is connected to a personal computer 92 via an interface process section 74 and a controller connector 76, serving as an upper-level unit.

The personal computer 92 is equipped with a driver 96 for performing a printing process on color-image data provided from a given application program 94. This driver 96 is connected to the controller connected 76 of the controller 62 via a personal-computer connector 98.

In the controller-dedicated MPU 72 of the controller 62, image memories 82-1 through 82-4 are mounted for storing image data dedicated to yellow (Y), magenta (M), cyan (C), and black (K) which data are transferred from the personal computer 92 and expanded into pixel data (dot data).

In the meantime, the controller-dedicated MPU 72 is connected to the engine 60 via an interface process section 78 and a controller connector 80, and executes a print control, i.e. giving print instructions to the engine 60 and receiving a control command, such as complete print preparation, from the engine 60 based on the print instructions. The positional-Error information detected by the engine 60 is received by the interface process section 78 so that positional-error correction can be made on the pixel data of the individual images expanded over the image memories 82-1 through 82-4.

The controller-dedicated MPU 72 is connected to an address designation section 84 for designating an address when expanding the individual color pixel data on the image memories 82-1 through 82-4. The address designation section 84 serves also to designate a readout address when, during the printing operation, the mechanical controller 64 performs readout/write-to-transfer of the individual color pixel data, which is expanded over the image memories 82-1 through 82-4, one after another in units of a longitudinal succession of lines in the primary scanning direction (perpendicular to the recording paper conveyance direction) of the LED arrays 36-1 through 36-4.

An address conversion section 86 also is connected to the address designation section 84. The address conversion section 86 performs an address conversion for position error correction based on the positional error information provided from the engine 60 via the interface process section 78.

The resolution of the individual color pixel data expanded over the image memories 82-1 through 82-4 is exemplified by 600 dpi in the primary scanning direction of the LED arrays 36-1 through 36-4 and 1800 dpi in the secondary scanning direction (the recording paper conveyance direction, the belt traveling direction).

Figure 1:
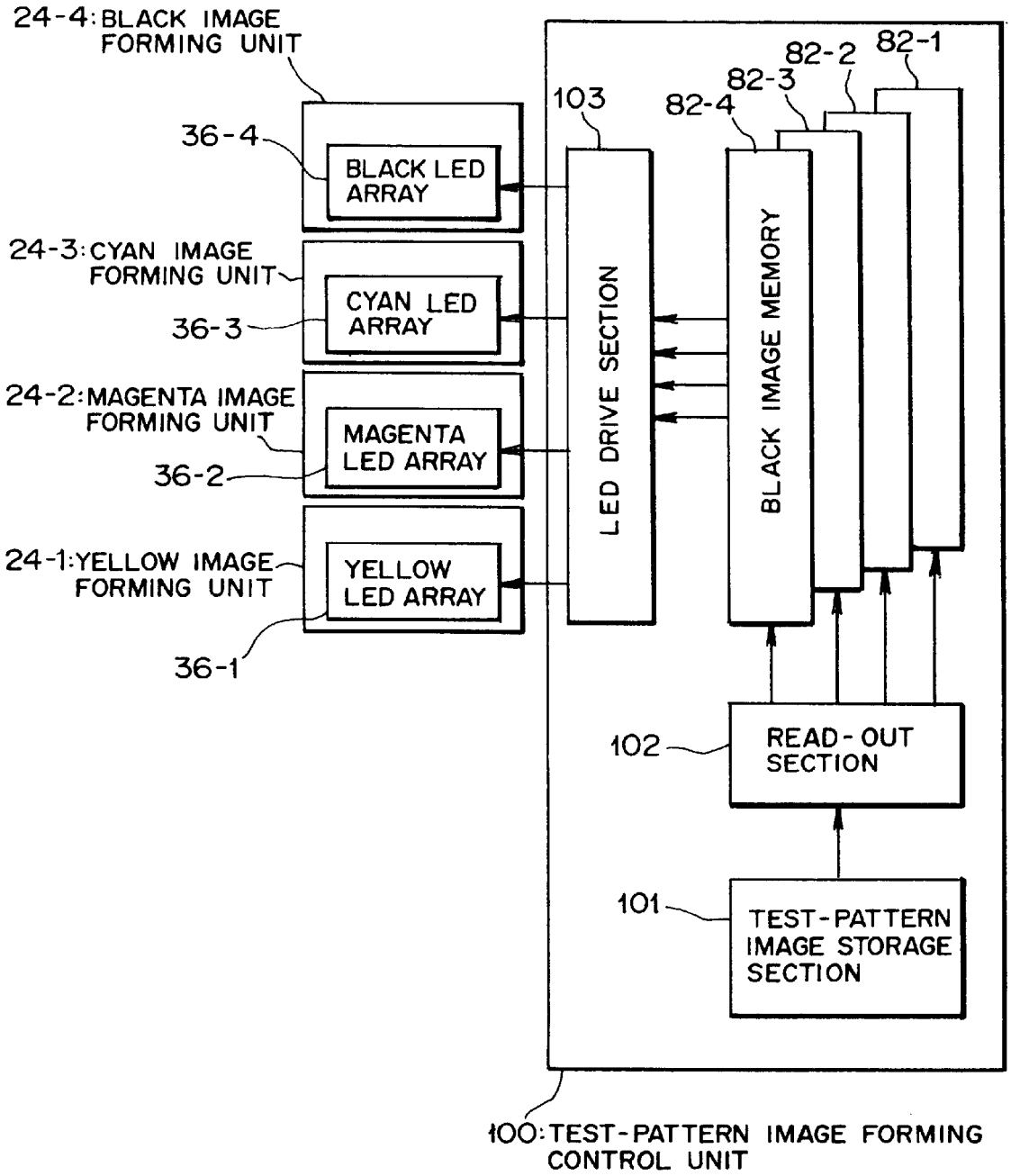
FIG. 1 is a function block diagram of an image forming apparatus according a first embodiment of the present invention.

Further, the controller 62, as illustrated in the function block of FIG. 1, functions a test-pattern image forming control unit 100 for controlling the plural electrostatic recording units (image forming units) 24-1 through 24-4 in order to form a test-pattern image T1 based on the test-pattern image data in accordance with a test-pattern image forming program.

The test-pattern image forming control unit 100 includes a test-pattern image storage section 101 storing test-pattern image data and a test-pattern image forming program, a read-out section 102 for reading out the test-pattern image data and the test-pattern image forming program, which are stored in the test-pattern image storage section 101, the image memories 82-1 through 82-4, and an LED driver 103.

The test-pattern image data stored in the test-pattern image storage section 101 includes (i) first data for forming reference color lines of the test-pattern image Ti, (ii) second data for forming a first mark TM1, which is low in density, by overlapping lines of another color, which is different from the reference color, with the reference color lines, and (iii) third data for forming second mark, which is high in density, by displacing the other color lines with respect to the reference color lines.

In the above-described manner, marks of different densities are formed simply by overlapping first and second color lines TL1, TL2 with one another, and a test-pattern image T1 is formed by bringing these marks of different densities to be disposed adjacent to one another, whereupon positional errors can be discriminated in terms of density difference between the individual regions simply by eyes. And by discriminating whether the current positional error occurring in a test pattern is a particular positional error corresponding to a known cause for such positional error, the custom engineer can judge comfortably what and how parts of the full-color printer should be repaired or inspected. More specifically, in order to form the first and second color lines TL1, TL2 within a predetermined region on white recording paper low in brightness, the individual regions of white, which is the original color of recording paper, is gradually reduced in size to vary the individual regions in density.

In the present embodiment, black (K), which is the most contrastive with the whole recording paper (printing sheet) among four colors, i.e. yellow (Y), magenta (M), cyan (C) and black (K), is selected as a reference color of the test-pattern image T1. This reference color is called the first color, and the three other colors, i.e. yellow, magenta and cyan, are collectively called the second color.

For this purpose, the black-dedicated electrostatic recording unit (black-dedicated image forming unit) 24-4 for forming a black image is used as the first image forming unit for forming the first color lines TL1. And the yellow-dedicated electrostatic recording unit (yellow-dedicated image forming unit) 24-1 for forming a yellow image, the magenta-dedicated electrostatic recording unit (magenta-dedicated image forming unit) 24-2 for forming a magenta image, and the cyan-dedicated electrostatic recording unit (cyan-dedicated image forming unit) 24-3 for forming a cyan image, are used as second image forming units for forming second color lines TL2.

The first data serves to arrange black lines (first color lines), each having a predetermined line width (e.g., a single dot width), at a predetermined pitch (e.g., 6-dot pitch (approximately 254 $\mu$m pitch)) using the black-dedicated electrostatic recording unit 24-4 as the first image forming unit.

The second data serves to arrange yellow lines, magenta lines and cyan lines as the second color lines TL2, each having the same line width as that of the black lines (e.g., a single dot width), at the same pitch as that of the black lines (e.g., 6-dot pitch (approximately 254 $\mu$m pitch)) so as to overlap with the black lines within a first region occupying part of an area (e.g., approximately 110-dot width) where the plural black lines are arranged, using the yellow-dedicated electrostatic recording unit 24-1, the magenta-dedicated electrostatic recording unit 24-2 and the cyan-dedicated electrostatic recording unit 24-4 as the second image forming nits, thereby forming first marks TM1.

Assuming that the second color lines TL2 are yellow lines, the second data serves to arrange a plurality of yellow lines, each having the same line width as that of the black lines, at the same pitch as that of the black lines so as to overlap with the black lines within the first region occupying part of the area where the black lines are arranged, to thereby form the first mark TM1 of the low density, using the yellow-dedicated electrostatic recording unit 24-1 as the second image forming unit. The resulting test-pattern image T1 composed of the black and yellow lines is called a yellow test-pattern image.

Likewise, if the second color lines TL2 are magenta lines, the second data serves to arrange a plurality of magenta lines, each having the same line width as that of the black lines, at the same pitch as that of the black lines so as to overlap with the black lines within the first region occupying part of the area where the black lines are arranged, to thereby form the first mark TM1 of the low density, using the magenta-dedicated electrostatic recording unit 24-2 as the second image forming unit. The resulting test-pattern image T1 composed of the black and magenta lines is called a magenta test-pattern image.

Also likewise, if the second color lines TL2 are cyan lines, the second data serves to arrange a plurality of cyan lines, each having the same line width as that of the black lines, at the same pitch as that of the black lines so as to overlap with the black lines within the first region occupying part of the area where the black lines are arranged, to thereby form the first mark TM1 of the low density, using the cyan-dedicated electrostatic recording unit 24-3 as the second image forming unit. The resulting test-pattern image T1 composed of the black and cyan lines is called a cyan test-pattern image.

The third data serves to arrange a plurality of yellow, magenta and cyan lines as the second color lines, each having the same line width as that of the black lines (e.g., a single dot width), at the same pitch as that of the black lines (e.g., 6-dot pitch (approximately 254 $\mu$m pitch)) so as to be displaced in a direction perpendicular to the black lines within a second region adjacent to the first region in the area where the black lines are arranged, to thereby form second marks TM2, using yellow-, magenta- and cyan-dedicated electrostatic recording units 24-1, 24-2, 24-3.

Specifically, the third data serves to arrange cyan lines, magenta lines and yellow lines with gradually varying the extent of displacement in the second region, which is divided into a plurality of sub-regions, from the black lines, thereby forming a plurality of second marks TM2 different in density. More specifically, the third data serves to arrange cyan lines, magenta lines and yellow lines with varying the extent of displacement from the black lines in the plural sub-regions gradually one dot by one dot.

For example, if the second color is yellow, the third data serves to arrange, in addition to black lines, yellow lines, each having the same line width as that of the black lines, at the same pitch as that of the black lines so as to be displaced from the black lines, with gradually varying the extent of displacement from the black lines in a direction perpendicular to the black lines for the individual sub-regions within the second region adjacent to the first region, to thereby form a plurality of second marks TM2 different in density for every sub-region of the second region. The resulting test-pattern image T1 composed of the black and yellow lines is called a yellow test-pattern image.

Likewise, if the second color is magenta, the third data serves to arrange, in addition to black lines, magenta lines, each having the same line width as that of the black lines, at the same pitch as that of the black lines so as to be displaced from the black lines, with gradually varying the extent of displacement from the black lines in a direction perpendicular to the black lines for the individual sub-regions within the second region adjacent to the first region, to thereby form a plurality of second marks TM2 different in density for every sub-region of the second region. The resulting test-pattern image T1 composed of the black and magenta lines is called a magenta test-pattern image.

Also likewise, if the second color is cyan, the third data serves to arrange, in addition to black lines, cyan lines, each having the same line width as that of the black lines, at the same pitch as that of the black lines so as to be displaced from the black lines, with gradually varying the extent of displacement from the black lines in a direction perpendicular to the black lines for the individual sub-regions within the second region adjacent to the first region, to thereby form a plurality of second marks TM2 different in density for every sub-region. The resulting test-pattern image T1 composed of the black and cyan lines is called a cyan test-pattern image.

The test-pattern image forming control unit 100 controls the black-dedicated electrostatic recording unit 24-4, as the first image forming unit, and the yellow-, magenta- and cyan-dedicated electrostatic recording units 24-1, 24-2, 24-3 as the second image forming units, so as to form a test-pattern image T1 composed of a first mark TM1 and a plurality of second marks TM2 such that the first and second marks TM1, TM2 are different in density and are disposed adjacent to each other.

For this purpose, as described above, the test-pattern image forming control unit 100 includes the readout section 102 for reading out the test-pattern image forming program stored in the test-pattern image storage section 101 and the above-mentioned test-pattern image data, the image memories 82-1 through 82-4, and the LED driver 103 in the form of an LED drive circuit which outputs control signal to energize the LED arrays 36-1 through 36-4 to emit light.

The read-out section 102 reads the test-pattern image data in accordance with the test-pattern image forming program stored in the test-pattern image storage section 101, expands the individual image data of yellow (Y), magenta (M), cyan (C) and black (K) of this test-pattern image data into pixel data (dot data), and stores the pixel data into the image memories 82-1 through 82-4 for every colors. The pixel data stored in the image memories 82-1 through 82-4 is then outputted to the LED drive circuit of the LED driver 103; based on control signals from the LED drive circuit, the LED arrays 36-1 through 36-4 are energized to emit light so as to form electrostatic latent images of test-pattern images T1 on the associated photosensitive drums 32-1 through 32-4. Further, the read-out section functions also as an address designation section to designate an address when expanding the image data into the pixel data of the individual colors on the image memories 82-1 through 82-4.

The test-pattern image T1, which is to be formed by executing the printing control with respect to the individual electrostatic recording units 24-1 through 24-4 according to the test-pattern image forming control unit 100 of the present embodiment, will now be described with reference to FIGS. 6 and 7.

Figure 6:
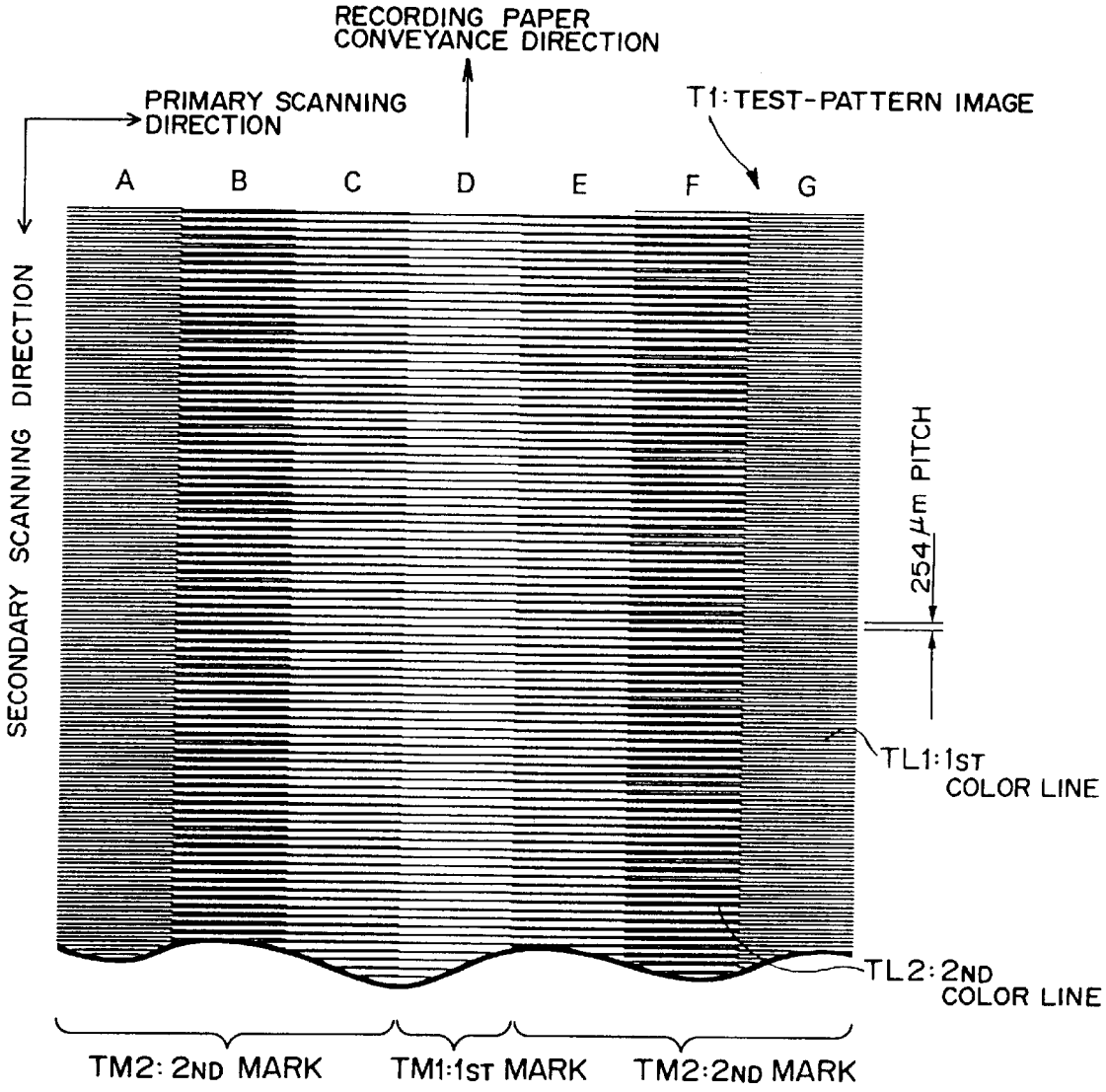
FIG. 6,is a fragmentary, enlarged diagram of a test-pattern image printed by the image forming apparatus of the first embodiment, illustrating the line arrangement of the test-pattern image.

In the present embodiment, as shown in FIG. 6, the test-pattern image T1 is composed of a plurality of transverse lines, all extending in the primary scanning direction perpendicular to the recording paper conveyance direction, the plural transverse lines including black lines as the first color lines, and cyan, magenta and yellow lines as the second color lines. In FIG. 6, a magenta test-pattern image T1 is shown. The details of the test-pattern image T1 will be described later.

Figure 7:
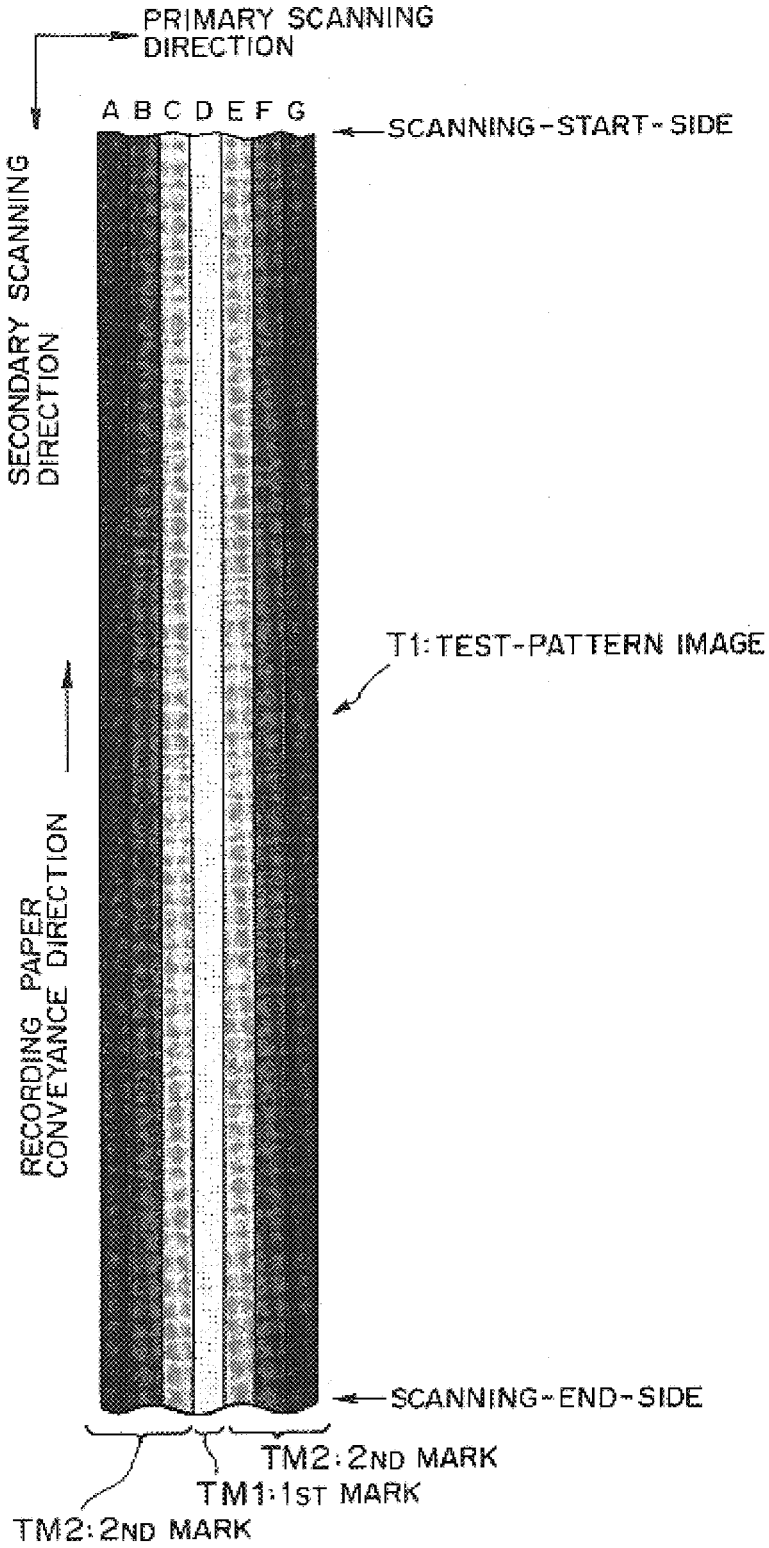
FIG. 7 is a diagram illustrating the individual regions composing a test-pattern image, which was printed by the image forming apparatus of the first embodiment, in terms of the density differences.

The test-pattern image T1 composed of first and second marks TM1, TM2, as shown in FIG. 7, contains a longitudinal succession of portions of a plurality of transversely extending black lines (first color lines) TL1, and extends continuously from the scanning-start-side to the scanning-end-side on the recording paper in the secondary scanning direction, each portion being one of transversely divided lengths of the individual black line. In FIG. 7, the second region is divided into a plurality of sub-regions (sub-regions A–C and sub-regions E–G), and a plurality of second marks TM2 are formed in the sub-regioans A–C and E–G; the individual marks are shown only in terms of shades, i.e. differences in density.

Alternatively, the test-pattern image T1 should by no means extend continuously from the scanning-start-side to the scanning-end-side on the recording paper in the secondary scanning direction and may be formed on the recording paper only at a scanning-start-side marginal region and a scanning-end-side marginal region in the secondary scanning direction.

The length of the test-pattern image T1 extending in the recording paper conveyance direction is preferably longer than the circumferential length (e.g., approximately 94.5 mm (30π)) if the electrostatic recording units 24-1 through 24-4 used as the plural image forming units are equipped with the respective photosensitive drums 32-1 through 32-4. As the result, possible positional errors occurring for every cycle of rotation of the individual photosensitive drums 32-1 through 32-4 periodically appear in the test-pattern image T1 as printed, the custom engineer can comfortably find the occurrence of possible change of rotational speed of the individual photosensitive drum 32-1 through 32-4 due to axial misalignment of the axis of rotation of the individual photosensitive drum 24-1 through 24-4 with the drum center line, or any other cause, simply by eyes.

To describe the test-pattern image T1 more specifically, FIG. 6 shows, on enlarged scale, a fragment of the magenta test-pattern image T1 as one example of test-pattern image T1. This test-pattern image T1 is an illustrative test-pattern image printed using a full-color printer whose pitch is 600 dpi (approximately 42.3 μm pitch).

In this test-pattern image T1, a plurality of transverse lines (extending in the primary scanning direction along their entire length), each having a predetermined line width (e.g., a single dot width), are drawn at every predetermined period (e.g., 6-dot period (approximately 254 μm pitch)) using black (K) toner as the first color; this is, a plurality of black lines, each having a predetermined line width, are arranged at a predetermined pitch (e.g., 6-dot period (approximately 254 μm pitch)).

Further, the region where the plural black lines are arranged is divided into a plurality of sub-regions, i.e. seven sub-regions A through G, which are arranged in transverse sequence (in the primary scanning direction). Within these seven sub-regions A through G, marks (first and second marks TM1, TM2) different in density are formed in a manner described later. Thus these seven marks are formed in longitudinal strips, and hence the test-pattern image T1 is formed as a test-pattern image composed of seven strip-shaped marks. The transverse width (the strip width, or the width in the primary scanning direction) of each of the sub-regions A through G may be set at option, preferably approximately 110-dot width (approximately 693 μm).

In the sub-region D occupying a central part of the seven sub-regions, a longitudinal succession of portions of transverse lines (magenta lines extending throughout the sub-region D), each having a predetermined line width (e.g., a single dot width), at a predetermined pitch. (e.g., 6-dot period (approximately 254 μm pitch)) are drawn in magenta toner so as to overlap with black lines, which are drawn in black toner. As a result, a plurality of magenta lines, each having the same line width as that of the black lines (e.g., a single dot width), are arranged at the same pitch as that of the black lines (e.g., 6-dot period (approximately 254 μm pitch)) so as to overlap with the black lines within the sub-region D (first region) occupying central part of all the sub-regions A through G where the plural black lines are arranged, thereby forming a first mark TM1.

And in the sub-region E (second region) contiguous to the central sub-region D on the right side, a longitudinal succession of portions of transverse lines (magenta lines extending throughout the sub-region E), each having a predetermined line width (e.g., a single dot width), at a predetermined pitch (e.g., 6-dot period (approximately 254 μm pitch)) are drawn in magenta toner so as to be displaced by an extent corresponding to a single dot (approximately 42.3 μm) toward the scanning-end-side in the secondary scanning direction (lower side in FIG. 6) with respect to the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region E (second region) contiguous to the central sub-region D (first region), thereby forming a second mark TM2.

Likewise, in the sub-region C (second region) contiguous to the central sub-region D on the left side, a longitudinal succession of portions of transverse lines (magenta lines extending throughout the sub-region C), each having a predetermined line width (e.g., a single dot width), are drawn in magenta toner so as to be displaced by an extent corresponding to a single dot (approximately 42.3 μm) toward the scanning-start-side on the recording paper in the secondary scanning direction (upper side in FIG. 6) from the black lines.

As a result, a plurality of magenta lines, each having the same line width as that of the black lines (e.g., a single dot width), are arranged at the same pitch as that of the black lines (e.g., 6-dot period (approximately 254 μm pitch)) so as to be is placed in a direction perpendicular to the black lines within the sub-region C (second region) contiguous to the central sub-region D (first region), thereby forming another second mark TM2.

And in the sub-region F (second region) contiguous to the sub-region E on the right side, a longitudinal succession of portions of transverse lines (magenta lines extending throughout the sub-region F), each having a predetermined line width (e.g., a single dot width), are drawn in magenta toner so as to be displaced by an extent corresponding to two dots (approximately 84.6 μm) toward the lower side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region F (second region) contiguous to the sub-region E (second region), thereby forming still another second mark TM2.

Likewise, in the sub-region B (second region) contiguous to the sub-region C on the left side, a longitudinal succession of portions of transverse lines (magenta lines extending throughout the sub-region B), each having a predetermined line width (e.g., a single dot width), are drawn in magenta toner so as to be displaced by an extent corresponding to two dots (approximately 84.6 Am) toward the upper side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region B (second region) contiguous to the sub-region C (second region), thereby forming an addition second mark TM2.

Further, in the sub-region G (second region, the outermost sub-region) contiguous to the sub-region F on the right side, a longitudinal succession of portions of transverse lines (magenta lines extending throughout the sub-region G), each having a predetermined line width (e.g., a single dot width), are drawn in magenta toner so as to be displaced by an extent corresponding to three dots (approximately 126.9 μm) toward the lower side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region G (second region) contiguous to the central sub-region F (second region), thereby forming a further second mark TM2.

Likewise, in the sub-region A (second region, the outermost sub-region) contiguous to the sub-region B on the left side, a longitudinal succession of portions of transverse lines (magenta lines extending throughout the sub-region A), each having a predetermined line width (e.g., a single dot width), are drawn in magenta toner so as to be displaced by an extent corresponding to three dots (approximately 126.9 μm) toward the upper side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region A (second region) contiguous to the sub-region B (second region), thereby forming still another second mark TM2.

Thus in the outermost sub-region A, the magenta lines are arranged with a displacement by an extent corresponding to three dots (approximately 126.9 μm) to the upper side from the black lines. As a result, either of the magenta and black lines is arranged at every sixth dots so that this sub-region A looks faraway in eyes the same color tone (density) as the outermost sub-region G where the magenta lines are arranged with displacement by three dots toward the lower side from the black lines.

And, in the sub-region B, the magenta lines are arranged with a displacement by an extent corresponding to two dots (approximately 84.6 μm) to the upper side from the black lines, and in the sub-region F, the magenta lines are arranged with a displacement by two dots (approximately 84.6 μm) toward the lower side from the black lines. Because they are identical with each other in size of un printed area of the original color of the recording paper, the sub-regions B and F faraway look the same color tone (density) in eyes.

Likewise, in the sub-region C, the magenta lines are arranged with a displacement by an extent corresponding to a single dot (approximately 42.3 μm) to the upper side from the black lines, and in the sub-region E, the magenta lines are arranged with a displacement by a single dot (approximately 42.3 μm) toward the lower side from the black lines. Because they are identical with each other in size of unprinted area of the original color of the recording paper, the sub-regions C and E faraway look the same color tone (density) in eyes.

A cyan test-pattern image and a yellow test-pattern image are printed in the manner discussed in connection with the magenta test-pattern image.

In the present embodiment, as the result of this printing, a composite test-pattern image is formed in which the yellow test-pattern, the magenta test-pattern and the cyan test-pattern are arranged in transverse sequence in the primary scanning direction.

Now the method of detecting a positional error (print error) using the thus printed test-pattern image T1 will be described with reference to (a) through (h) of FIG. 8.

FIG. 8, (a) through (h), shows individual extents of positional errors between black and magenta (between K–M) of the magenta test-pattern image T1. In (a) through (h) of FIG. 8, the second region is divided into a plurality of sub-regions (sub-regions A through C and E through G), and a plurality of second marks TM2 are formed within these sub-regions. In FIG. 8, the individual marks are shown only in shades.

(a) of FIG. 8 shows stepwise variations of density (visible) of a test-pattern image T1 in the absence of any positional error (positional error extent is ±0 dot).

In (a) of FIG. 8, the central sub-region D (the first region or D lane) looks like almost a black line group because transverse lines of black (K) (black lines) are overlapping with transverse lines of magenta (M) (magenta lines) so as to fully cover the magenta lines on image data. Namely, because recording paper is white, this sub-region D would generally become a black-while mark.

The regions (the second region, the sub-region A through C and the sub-region E through G) contiguous to the central sub-region D looks in a mixed color of black and magenta in eyes because black lines gradually separate from magenta lines, and vice versa. In these regions, on image data, since the extent of displacement of magenta lines from black lines varies gradually as it goes away from the central sub-region D, the area of the original color (usually white) of recording paper unprinted in black (K) or magenta (M) is gradually reduced as it goes away from the central sub-region D so that a black-white mark with white more influential gradually changes to a magenta-black mark with white less influential. As a result, the outermost sub-region G (or the sub-region A) looks highest in tone of magenta (M). In other words, since the area of white, whose density (brightness) is lowest, becomes smaller as it goes away from the central sub-region D toward the outer sub-region, it presumably becomes gradually higher in density as it goes away from the central sub-region D toward the outer sub-region.

As shown in (a) of FIG. 8, if the central sub-region D of the test-pattern image T1 is lowest in density, it is judged that the extent of positional error is zero.

(c) of FIG. 8 shows stepwise variations of density (visible) of a test-pattern image T1 when the extent of positional error is ±1 dot (displaced by 1 dot toward the upper side on the recording paper).

In (c) of FIG. 8, the sub-region E is lowest in density.

Namely, the sub-region E is lowest in tone of magenta (M). This indicates that the magenta lines are disposed in substantially the same position as the black lines as the result of displacement by an extent corresponding to 1 dot (approximately 42.3 μm) toward the lower side from the black lines in the sub-region E where the magenta lines should have been displaced by 1 dot (approximately 42.3 μm) toward the upper side from the black lines.

Consequently, as shown in (c) of FIG. 8, in the printed test-pattern image T1, assuming that the extent of positional error toward the upper side of the recording paper with respect to the black lines when the sub-region E is lowest in density is defined as a positive error extent, it is possible to judge that the positional error extent of the magenta lines is approximately +42.3 μm (corresponding to 1 dot)

In the meantime, (h) of FIG. 8 shows stepwise variations of density (visible) of a test-pattern image T1 when the extent of positional error is −1 dot (displaced by 1 dot toward the lower side of the recording paper).

In (h) of FIG. 8, the sub-region C is lowest in density. Namely, the sub-region C is lowest in tone of magenta (M). This indicates that the magenta lines are disposed in substantially the same position as the black lines as the result of displacement by an extent corresponding to 1 dot (approximately 42.3 μm) toward the lower side from the black lines in the sub-region C where the magenta lines should have been displaced by 1 dot (approximately 42.3 μm) toward the upper side from the black lines.

Consequently, as shown in (h) of FIG. 8, in the printed test-pattern image T1, assuming that the extent of positional error toward the upper side of the recording paper with respect to the black lines when the sub-region C is lowest in density is defined as a positive error extent, it is possible to judge that the positional error extent of the magenta lines is approximately −42.3 μm (corresponding to 1 dot).

In the meantime, (d) of FIG. 8 shows step wise variations of density (visible) of a test-pattern image T1 when the extent of positional error is +2 dots (displaced by 2 dot s toward the lower side of the recording paper).

In (d) of FIG. 8, the sub-region F is lowest in density. Namely, the sub-region F is lowest in tone of magenta (M). This indicates that the magenta lines are disposed in substantially the same position as the black lines as the result of displacement by an extent corresponding to 2 dot s (approximately 84.6, μm) toward the upper side from the black lines in the sub-region F where the magenta lines should have been displaced by 2 dot s (approximately 84.6 μm) toward the lower side from the black lines.

Consequently, as shown in (d) of FIG. 8, in the printed test-pattern image T1, if the sub-region F is lowest in density, it is possible to judge that the positional error extent of the magenta lines is approximately +84.6 μm (corresponding to 2 dot s).

In the meantime, (g) of FIG. 8 shows stepwise variations of density (visible) of a test-pattern image T1 when the extent of positional error is −2 dots (displaced by 2 dot s toward the lower side of the recording paper).

In (g) of FIG. 8, the sub-region B is lowest in density.

Namely, the sub-region B is lowest in tone of magenta (M). This indicates that the magenta lines are disposed in substantially the same position as the black lines as the result of displacement by an extent corresponding to 2 dots (approximately 84.6 μm) toward the lower side from the black lines in the sub-region B where the magenta lines should have been displaced by 2 dots (approximately 84.6 μm) toward the upper side from the black lines.

Consequently, as shown in (g) of FIG. 8, in the printed test-pattern image T1, if the sub-region B is lowest in density, it is possible to judge that the positional error extent of the magenta lines is approximately −84.6 μm (corresponding to 2 dots).

Further, (e) of FIG. 8 shows stepwise variations of density (visible) of a test-pattern image T1 when the extent of positional error is +3 dots (displaced by 3 dots toward the upper side of the recording paper).

In (e) of FIG. 8, the sub-region G is lowest in density. Namely, the sub-region G is lowest in tone of magenta (M). This indicates that the magenta lines are disposed in substantially the same position as the black lines as the result of displacement by an extent corresponding to 3 dots (approximately 126.9 μm) toward the upper side from the black lines in the sub-region G where the magenta lines should have been displaced by 3 dots (approximately 126.9 μm) toward the lower side from the black lines.

Consequently, as shown in (e) of FIG. 8, in the printed test-pattern image T1, if the sub-region G is lowest in density, it is possible to judge that the positional error extent of the magenta lines is approximately +126.9 μm (corresponding to 3 dots).

The sub-region A also is lowest in density. This is because the magenta lines are disposed in substantially the same position as the black lines in the sub-region A where the magenta lines should have been displaced by an extent corresponding to 3 dots (approximately +126.9 μm) toward the upper side from the black lines.

In the meantime, (f) of FIG. 8 shows stepwise variations of density (visible) of a test-pattern image T1 when the extent of positional error is −3 dots (displaced by 3 dots toward the lower side of the recording paper).

In (f) of FIG. 8, the sub-region A is lowest in density. Namely, the sub-region A is lowest in tone of magenta (M). This indicates that the magenta lines are disposed in substantially the same position as the black lines as the result of displacement by an extent corresponding to 3 dots (approximately 126.9 μm) toward the lower side from the black lines in the sub-region A where the magenta lines should have been displaced by 3 dots (approximately 126.9 μm) toward the upper side from the black lines.

Consequently, as shown in (f) of FIG. 8, in the printed test-pattern image T1, if the sub-region G is lowest in density, it is possible to judge that the positional error extent of the magenta lines is approximately −126.9 μm (corresponding to 3 dots).

The sub-region G also is lowest in density. This is because the magenta lines are disposed in substantially the same position as the black lines in the sub-region G where the magenta lines should have been displaced by an extent corresponding to 3 dots (approximately +126.9 μm) toward the lower side from the black lines.

(b) of FIG. 8 shows stepwise variations of density (visible) of a test-pattern image T1 when the extent of positional error is +0.5 dot. In (b) of FIG. 8, the central sub-region D and the sub-region E contiguous to it are substantially the same in tone. If the difference in density between adjacent sub-regions is scarce, it is possible to judge that the extent of positional error is less than 1 dot (approximately 42.3 μm).

In the illustrated examples, the direction and extent of positional error is judged by checking up the position of the lowest-density sub-region. Alternatively, the direction and extent of positional error may be judged by checking up the position of the highest-density sub-region. As another alternative, the direction and position of the positional error may be judged by checking up the position of a particular-density sub-region.

Thus according to the foregoing test-pattern image T1, if the extent of positional error is within a range of ±3 dots (approximately ±127 μm), it is possible to judge the position error extent by discriminating which one of the sub-regions A through G is the lowest in density. The able-to-judge range of positional error extent can be extended by increasing the pitch of black lines (first color lines) TL1, which are reference lines, to increase the number of sub-regions where a mark of different densities is to be formed.

In the foregoing illustrated examples, the positional error is detected using a magenta test-pattern image T1. Alternatively, a cyan test-pattern image or a yellow test-pattern image may be used with the same results.

In the present embodiment, since the test-pattern image T1 is formed in the above-mentioned manner, it is possible to realize the following judgments, using this test-pattern image T1 when the printer is shipped from a factory or when the custom engineer repairs or inspects the printer in user's site.

It is possible to grasp a change in the secondary Scanning direction in extent of positional error in the secondary scanning direction by observing this test-pattern image T1 by eyes, thereby discriminating whether or not there have occurred any change of rotational speed of the individual photosensitive drum 32-1 through 32-4 or any change of feed speed of recording paper (print sheet), which can be assumed as a cause for the change in the secondary scanning direction in extent of positional error in the secondary scanning direction (uneven printing in the secondary scanning direction).

For example, if a positional error (uneven printing) has occurred for every cycle of rotation of the individual photosensitive drum 32-1 through 32-4 in the printed test-pattern image T1, it is possible to judge that the change of rotational speed of the individual photosensitive drum 32-1 through 32-4 has occurred due to misalignment of the center line of rotation of the individual photosensitive drum 32-1 through 32-4 with the drum axis. In such event, the custom engineer copes with this trouble by exchanging the existing electrostatic recording unit (print unit) equipped with the photosensitive drum 32-1 through 32-4 with a new one.

If the printed test-pattern image T1 has wholly displaced toward the minus side (lower side of recording paper), it is possible to judge that the conveyor belt 12 has encountered slipping.

In the illustrated example of the present invention, the yellow-, magenta-, cyan- and black-dedicated electrostatic recording units are arranged in this sequence from the upstream side in the recording paper conveyance direction. If the ratio of the (K-C) positional error extent between black and cyan, the (K-M) positional error extent between black and magenta, and the (K-Y) positional error extent between black and yellow is 1:2:3, it is possible to judge that the conveyor belt 12 has encountered slipping. In this case, the custom engineer copes with this slipping by exchanging the existing conveyor belt unit 11 with a new one or by inputting instructions on an operation panel so as to change the moving speed of the conveyor belt 12.

By comparing the upper and lower sides of the printed test-patter image T1 with each other, it is possible to make the following judgments.

For example, if the printed test-pattern image T1 has been displaced at the lower side by a greater extent toward the plus side (upper side of recording paper) as compared to at the upper side, it is possible to judge that the speed of rotation of the fixing roller 26 disposed downstream of the electrostatic recording unit 24-1 through 24-4 has been too fast. In this case, the custom engineer copes with this over-speed rotation by inputting instructions on the operation panel so as to decrease the current speed of rotation of the fixing roller 26.

Otherwise if the printed test-pattern image T1 has been displaced at the lower side by a greater extent toward the minus side (lower side of recording paper) as compared to at the upper side, it is possible to judge that the speed of rotation of the fixing roller 26 disposed downstream of the electrostatic recording unit 24-1 through 24-4 has been too slow. In this case, the custom engineer copes with this under-speed rotation by inputting instructions on the operation panel so as to increase the current speed of rotation of the fixing roller 26.

In the meantime, if the printed test-pattern image T1 has been displaced at the upper side by a greater extent toward the plus side (upper side of recording paper) as compared to at the lower side, it is possible to judge that the speed of rotation of the registration roller 20 disposed upstream of the electrostatic recording unit 24-1 through 24-4 has been too fast. In this case, the custom engineer copes with this over-speed rotation by inputting instructions on the operation panel so as to decrease the current speed of rotation of the registration roller 20.

Otherwise if the printed test-pattern image T1 has been displaced at the upper side by a greater extent toward the minus side (lower side of recording paper) as compared to at the lower side, it is possible to judge that the speed of rotation of the registration roller 20 disposed downstream of the electrostatic recording unit 24-1 through 24-4 has been too slow. In this case, the custom engineer copes with this under-speed rotation by inputting instructions on the operation panel so as to increase the current speed of rotation of the registration roller 20.

Figure 9:
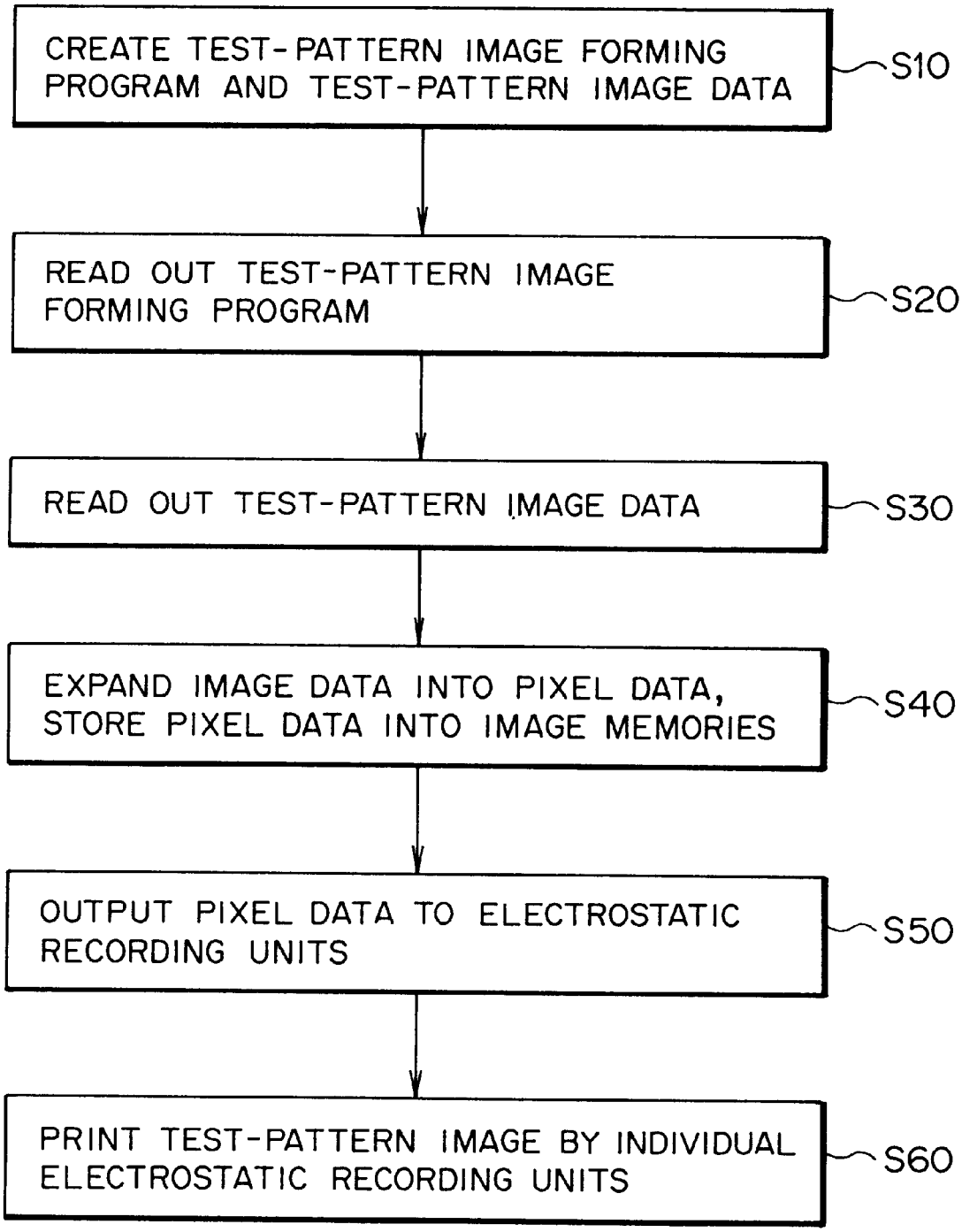
FIG. 9 is a flow diagram illustrating the procedure in which a test-pattern image is formed according to the first embodiment.

The test-pattern image forming method according to the present first embodiment will now be described with reference to the flow diagram of FIG. 9.

First of all, test-pattern image data and test-pattern image forming program are created, and are stored in the test-pattern image storage section 101 of the test-pattern image forming control unit 100 (step S10).

This test-pattern image data includes (i) first data for forming lines of a reference color of the test-pattern image T1, (ii) second data for forming a first mark TM1, which is low in density, by overlapping lines of another color, which is different from the reference color, with the reference color line, and (iii) third data for forming second mark, which is high in density, by displacing the other color lines with respect to the reference color lines.

The first data serves to arrange black lines (first color lines), each having a predetermined line width (e.g., a single dot width), at a predetermined pitch (e.g., 6-dot pit (approximately 254 mm pitch)) using the black-dedicated electrostatic recording unit 24-4 as the first image forming unit.

The second data serves to arrange yellow lines, magenta lines and cyan lines as the second color lines TL2, each having the same line width as that of the black lines (e.g., a single dot width), at the same pitch as that of the black lines (e.g., 6-dot pit (approximately 254 $\mu$m pitch)) so as to overlap with the black lines within a first region (sub-region D in FIG. 6) occupying part of an area (e.g., approximately 110-dot width) where the plural black lines are arranged, using the yellow-dedicated electrostatic recording unit 24-1, the magenta-dedicated electrostatic recording unit 24-2 and the cyan-dedicated electrostatic recording unit 24-4 as the second image forming units, thereby forming first marks TM1.

The third data serves to arrange a plurality of yellow, magenta and cyan lines as the second color lines, each having the same line width as that of the black lines (e.g., a single dot width), at the same pitch as that of the black lines (e.g., 6-dot pitch (approximately 254 $\mu$m pitch)) so as to be displaced in a direction perpendicular to the black lines within a second region (sub-regions A–C, sub-regions E–G) adjacent to the first region (sub-region D in FIG. 6) in the area where the black lines are arranged, to thereby form second marks TM2, using yellow-, magenta- and cyan-dedicated electrostatic recording units 24-1, 24-2, 24-4.

Then the test-pattern image program is executed to print a test pattern based on the thus created test-pattern image data.

The read-out section 102 reads out the test-pattern image forming program from the test-pattern image storage section 101 of the test-pattern image forming control unit 100 (step S20).

In accordance with this program, the read-out section 102 reads out the test-pattern image data stored in the test-pattern image storage section 101 (step S30).

From this test-pattern image data, a test-pattern image is generated as discomposed in four different colors of yellow (Y), magenta (M), cyan (C) and black (K), and is expanded into pixel data (dot data), whereupon the pixel data is stored in the image memories 82-1 through 82-4 provided one for each color (step S40). At that time, the yellow test-pattern image is stored in the image memory 82-1; the magenta test-pattern image, in the image memory 82-2; the cyan test-pattern image, in the image memory 82-3; the black test-pattern image, in the image memory 82-4.

The test-pattern image forming control unit 100 outputs the pixel data, which has been stored in the image memories 82-1 through 82-4, to the electrostatic recording units (image forming units) 24-1 through 24-4 provided one for each color (step S50).

Then the individual electrostatic recording units 24-1 through 24-4 performs printing processes one for each color (step S60).

The printing process for yellow (Y) starts with reading the yellow pixel data from the image memory 82-1 and outputting the yellow pixel data to the corresponding electrostatic recording unit 24-1. Likewise, the printing process for each of magenta (M), cyan (C) and black (K) start with reading the pixel data of the individual color from the associated image memory 82-2, 82-3, 82-4 and outputting the individual color pixel data to the corresponding electrostatic recording unit 24-2, 24-3, 24-4.

Thus, based on the first and second data, the printing processes for lines of yellow (Y), magenta (M), cyan (C) and black (K) are performed by the respective electrostatic recording units 24-1 through 24-4 in such a manner that the line images of different colors are formed so as to overlap with one another. A first mark TM1 is formed by overlapping the cyan lines, magenta lines and yellow lines with the black lines on the recording paper. And a second mark TM 2 is formed so as to be disposed adjacent to the first mark TM1 by displacing the cyan lines, magenta lines and yellow lines with respect to the black lines. As a result, a test-pattern image T1 composed of the first and second marks TM1, TM2 having different densities.

According to the image forming apparatus and test-pattern image forming method of the present embodiment, a test-pattern image T1 composed of the first and second marks TM1, TM2 having different densities is formed, based on the test-pattern image data that includes: (i) the first data serving to arrange the black lines as the first color lines, (ii) the second data serving to arrange the yellow lines, magenta lines and cyan lines, as the second color lines, so as to overlap the black lines to thereby form the first mark TM1, and (iii) the third data serving to arrange the yellow lines, magenta lines and cyan lines with a displacement with respect to the black lines so as to form the second mark TM2. It is therefore possible to form the test-pattern image T1 in a simple manner so that the positional error can be easily recognized by eyes.

Further, partly because the second region is divided into a plurality of sub-regions (sub-regions A through C and sub-regions E through G), and partly because a plurality of second marks TM2 having different densities are formed in the plural sub-regions where the second color lines TL2 are arranged with gradually varying in extent of displacement with respect to the first color lines, it is possible to recognize the position error more easily.

In particular, since the plural second marks TM 2 having different densities are formed by arranging the second color lines TL2, each having a predetermined line with corresponding to 1 dot width, with gradually varying in extent of displacement with respect to the first color lines 1 dot by 1 dot in the second region divided into a plurality of sub-regions, it is possible to judge the position error in units of a single dot simply by observing the test-pattern image T1 by eyes.

Further, partly because each of the first and second color lines is a transverse line extending in the primary scanning direction perpendicular to the recording paper conveyance direction, and partly because the test-pattern image T1 composed of the first ad second marks TM1, TM2 contains a longitudinal succession of portions of the black lines and extends continuously from the scanning-start-side marginal portion to the scanning-end-side marginal portion in the secondary scanning direction of the recording paper, it is possible to judge a change in the secondary scanning direction in the positional error extent in the secondary scanning direction precisely in terms of the positional error in the primary scanning direction of the individual mark as the test-pattern image T1 with the second color lines TL2 displaced in the secondary scanning direction is observed by eyes for shipment of the printer at a factory or for maintenance, inspection or repairing of the printer at user's site by the customer engineer (CE). As a result, it is possible to grasp a change in the secondary scanning direction in extent of positional error in the secondary scanning direction, thereby discriminating whether or not there have occurred any change of rotational speed of the individual photosensitive drum 32-1 through 32-4 or any change of feed speed of recording paper (print sheet), which can be assumed as a cause for the change in the secondary scanning direction in extent of positional error in the secondary scanning direction (uneven printing in the secondary scanning direction), performing exchange of parts and mechanical adjustments of positions of parts exactly and efficiently.

Particularly, the electrostatic recording units 24-1 through 24-4 each equipped with a photosensitive drum for a different color are used as the respective image forming units. With this arrangement, by forming the test-pattern image T1 so as to have a length larger than the circumferential length of the photosensitive drum 32-1 through-32-4 equipped with the first and second image forming units, it is possible to exactly recognize a change in speed of rotation of the photosensitive drum 32-1 through 32-4 that is presumably a cause for the error in the secondary scanning direction in displacement in the secondary scanning direction.

Further, because a combination of test-pattern images, including a cyan test-pattern image, which is composed of black lines and cyan lines, a magenta test-pattern image, which is composed of black lines and magenta lines, a yellow test-pattern image, which is composed of black lines and yellow lines, are formed in parallel arrangement in the primary scanning direction, the customer engineer can grasps the position error for each and every color easily and efficiently. Further, since black (K), which is the most contrastive with the whole recording paper (printing sheet) among four colors, i.e. yellow (Y), magenta (M), cyan (C) and black (K), is selected as a reference color of the test-pattern image T3, the customer engineer can grasps the positional error more easily.

Further, by forming the foregoing test-pattern image T1 (see FIG. 6) on the recording paper at at least the scanning-start-side marginal portion and the scanning-end-side marginal portion in the secondary scanning direction, it is possible to calculate a skew angle with respect to the recording paper conveyance direction (i.e., the secondary scanning direction) using these positional error extents of the test-pattern image T1. Namely, by obtaining the positional error extent in the secondary scanning direction for the test-pattern images respectively formed in the scanning-start-side marginal portion and the scanning-end-side marginal portion, it is possible to calculate an angular displacement between the individual test-pattern images, namely, a skew angle corresponding to the angular displacement with respect to the secondary scanning direction.

If there has occurred a skew angle corresponding to the angular displacement with respect to the secondary scanning direction, the customer engineer can cope with this error by inputting instructions on the operation panel to correct when expanding the image data on the image memories into the pixel data. In the event that this correcting does not suffice, then the customer engineer can cope with the error by remounting the exposure device.

A modified image forming apparatus and a modified test-pattern image forming method according to a second embodiment of the present invention will now be described with reference to FIGS. 10 and 11.

The modified image forming apparatus of the second embodiment is identical in the basic form of test-pattern image data with that of the first embodiment, and is different therefrom in that lines of the individual colors composing a test-pattern image T2 are longitudinal lines.

Figure 10:
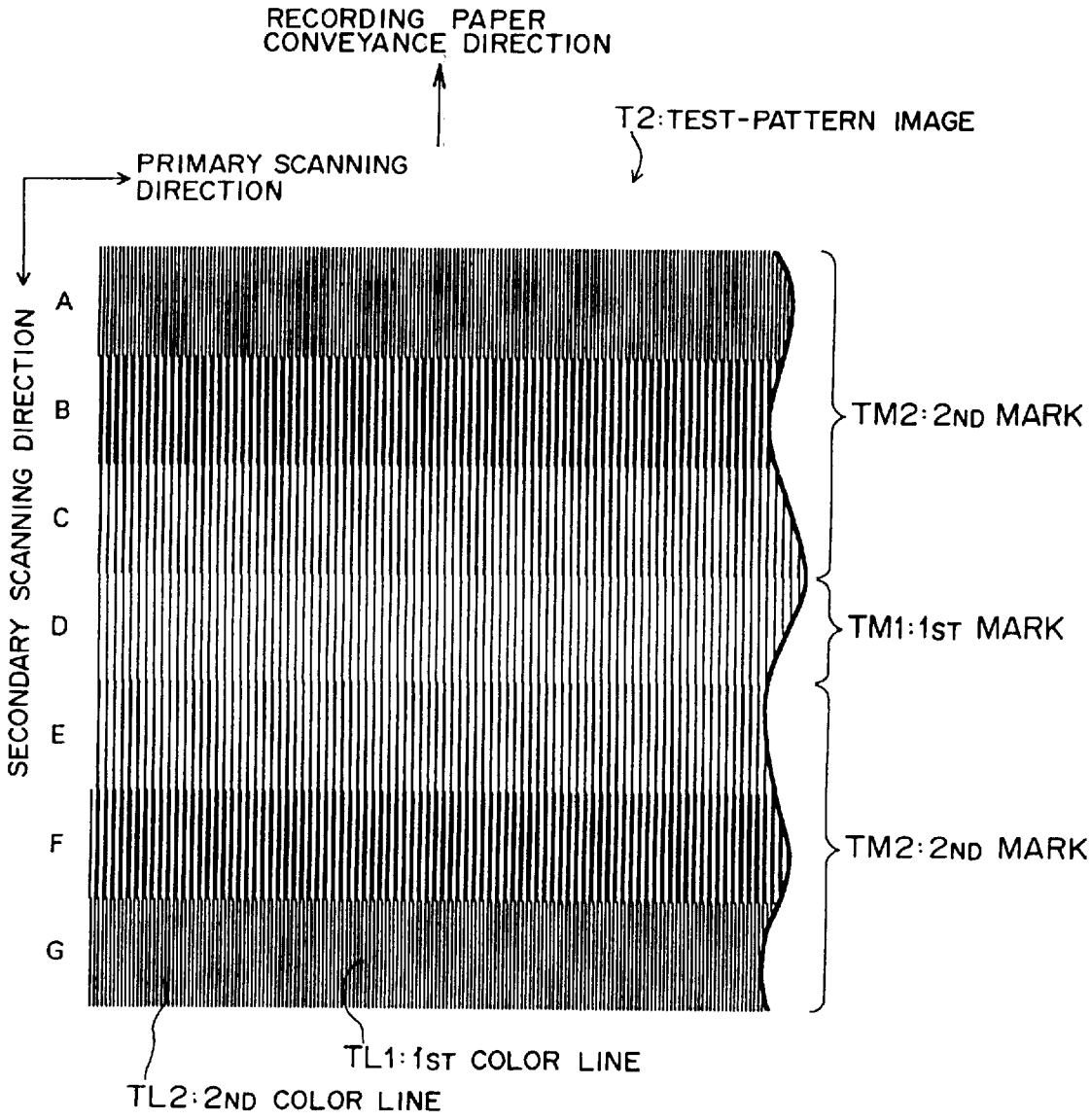
FIG. 10 is a fragmentary, enlarged diagram of an alternative test-pattern image printed by an image forming apparatus according to an a second embodiment of the present invention, showing the line arrangement of the test-pattern image.

Specifically, in the second embodiment, the test-pattern image T2, which is to be formed by executing print control for electrostatic recording units 24-1 through 24-4 by a test-pattern image forming control unit 100, is composed by black lines as the first color lines TL1, and cyan lines, magenta lines and yellow lines as the second color lines TL2, each color line being a longitudinal line extending in the recording paper conveyance direction as shown in FIG. 10. The details of the test-pattern image T2 will be described later.

Figure 11:
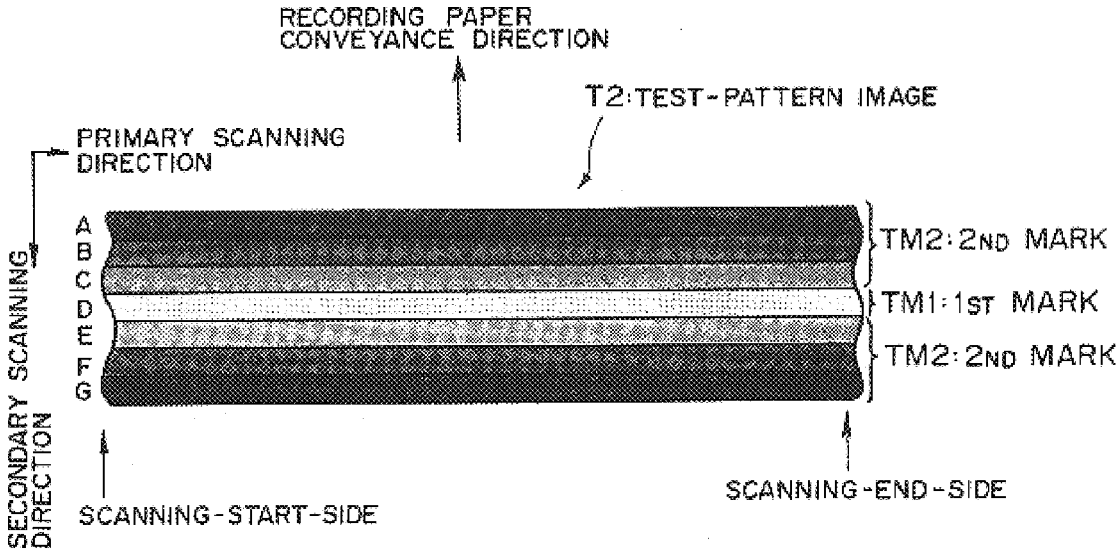
FIG. 11 is a diagram illustrating the individual regions of a test-pattern image, which was printed by the image forming apparatus of the first embodiment, in terms of the density differences.

And the test-pattern image T2 composed of first and second marks TM1, TM2, as shown in FIG. 11, contains a transverse succession of portions of longitudinal black lines (first color lines) TL1, and extends continuously from the scanning-start-side to the scanning-end-side on the recording paper in the primary scanning direction perpendicular to the recording paper conveyance direction, each portion being one of longitudinally divided lengths of the individual black line. In FIG. 11, the second region is divided into a plurality of sub-regions (sub-regions A–C and sub-regions E–G), and a plurality of second marks TM2 are formed in the sub-regions A–C and E–G; the individual marks are shown only in terms of shades, i.e. differences in density.

Alternatively, the test-pattern image T2 should by no means extend continuously from the scanning-start-side to the scanning-end-side on the recording paper in the primary scanning direction perpendicular to the recording paper conveyance direction and may be formed on the recording paper only at a scanning-start-side marginal region and a scanning-end-side marginal region in the primary scanning direction.

For this purpose, in the second embodiment, likewise the first embodiment, the black-dedicated electrostatic recording unit (black-dedicated image forming unit) 24-4 for forming a black image is used as the first image forming unit for forming the first color lines TL1. And the yellow-dedicated electrostatic recording unit (yellow-dedicated image forming unit) 24-1 for forming a yellow image, the magenta-dedicated electrostatic recording unit (magenta-dedicated image forming unit) 24-2 for forming a magenta image, and the cyan-dedicated electrostatic recording unit (cyan-dedicated image forming unit) 24-3 for forming a cyan image, are used as second image forming units for forming second color lines TL2.

And the test-pattern image forming control unit 100 controls the black-dedicated electrostatic recording unit 24-4, as the first image forming unit, and the yellow-, magenta- and cyan-dedicated electrostatic recording units 24-1, 242, 24-4, as the second image forming units, so as to form a combination of test-pattern images composed of a magenta test-pattern image, which is composed of black lines (first color lines) TL1 and magenta lines (second color lines) TL2, a cyan test-pattern image, which is composed of black lines TL1 and cyan lines (second color lines) TL2, and a yellow test-pattern image, which is composed of black lines TL1 and yellow lines (second color lines) TL2, which test-pattern images are arranged in series in the secondary scanning direction.

The remaining construction of the second embodiment is identical with that of the first embodiment, so its description is omitted here.

FIG. 10 shows, on enlarged scale, a fragment of the magenta test-pattern image as one example of test-pattern image T2. This test-pattern image T2 is an illustrative test-pattern image printed using a full-color printer whose pitch is 600 dpi (approximately 42.3 μm pitch).

In this test-pattern image T2, a plurality of longitudinal lines (extending throughout seven sub-regions A through G, which are arranged in longitudinal sequence in the secondary scanning direction), each having a predetermined line width (e.g., a single dot width), are drawn at every predetermined period (e.g., 6-dot period (approximately 254 μm pitch) ) using black (K) toner as the first color; this is, a plurality of black lines, each having a predetermined line width, are arranged at a predetermined pitch (e.g., 6-dot period (approximately 254 μm pitch)).

Further, the region where the plural black lines are arranged is divided into a plurality of sub-regions, i.e. seven sub-regions A through G, which are arranged in longitudinal sequence (in the secondary scanning direction). Within these seven sub-regions A through G, marks (first and second marks TM1, TM2) different in density are formed in a manner described later. Thus these seven marks are formed in transverse strips, and hence the test-pattern image T2 is formed as a test-pattern image T2 composed of seven strip-shaped marks. The longitudinal width (the strip width, or the width in the secondary scanning direction) of each of the sub-regions A through G may be set at option, preferably approximately 110-dot width (approximately 693 μm).

In the sub-region D occupying a central part of the seven sub-regions, a transverse succession of portions of longitudinal lines (magenta lines extending throughout the sub-region D), each having a predetermined line width (e.g., a single dot width), at a predetermined pitch (e.g., 6-dot period (approximately 254 μm pitch)) are drawn in magenta toner so as to overlap with black lines, which are drawn in black toner. As a result, a plurality of magenta lines, each having the same line width as that of the black lines (e.g., a single dot width), are arranged at the same pitch as that of the black lines (e.g., 6-dot period (approximately 254 μm pitch)) so as to overlap with the black lines within the sub-region D (first region) occupying central part of all the sub-regions A through G where the plural black lines are arranged, thereby forming a first mark TM1.

And in the sub-region E (second region) contiguous to the central sub-region D on the lower side, a transverse succession of portions of longitudinal lines (magenta lines extending throughout the sub-region E), each having a redetermined line width (e.g., a single dot width), at a redetermined pitch (e.g., 6-dot period (approximately 254 μm pitch)) are drawn in magenta toner so as to be displaced by an extent corresponding to a single dot (approximately 42.3 μm) toward the scanning-end-side in the primary scanning direction (right side in FIG. 10) with respect to the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region E (second region) contiguous to the central sub-region D (first region), thereby forming a second mark TM2.

Likewise, in the sub-region C (second region) contiguous to the central sub-region D on the upper side, a transverse succession of portions of longitudinal lines (magenta lines extending throughout the sub-region C), each having a predetermined line width (e.g., a single dot width), are drawn in magenta toner so as to be displaced by an extent corresponding to a single dot (approximately 42.3 μm) toward the scanning-start-side on the recording paper in the primary scanning direction (left side in FIG. 10) from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region C (second region) contiguous to the central sub-region D (first region), thereby forming another second mark TM2.

And in the sub-region F (second region) contiguous to the sub-region E on the lower side, a transverse succession of portions of longitudinal lines (magenta lines extending throughout the sub-region F), each having a predetermined line width (e.g., a single dot width), are drawn in magenta toner so as to be displaced by an extent corresponding to two dots (approximately 84.6 μm) toward the right side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region F (second region) contiguous to the sub-region E (second region), thereby forming still another second mark TM2.

Likewise, in the sub-region B (second region) contiguous to the sub-region C on the upper side, a transverse succession of portions of longitudinal lines (magenta lines extending throughout the sub-region B), each having a predetermined line width (e.g., a single dot width), are drawn in magenta toner so as to be displaced by an extent corresponding to two dots (approximately 84.6 μm) toward the left side in the primary canning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region B (second region) contiguous to the sub-region C (second region), thereby forming an addition second mark TM2.

Further, in the sub-region G (second region, the outermost sub-region) contiguous to the sub-region F on the lower side, a transverse succession of portions of longitudinal lines (magenta lines extending throughout the sub-region G), each having a predetermined line width (e.g., a single dot width), are drawn in magenta toner so as to be displaced by an extent corresponding to three dots (approximately 126.9 μm) toward the right side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region G (second region) contiguous to the sub-region F (second region), thereby forming a further second mark TM2.

Likewise, in the sub-region A (second region, the outermost sub-region) contiguous to the sub-region B on the upper side, a transverse succession of portions of longitudinal lines (magenta lines extending throughout the sub-region A), each having a predetermined line width (e.g., a single dot width), are drawn in magenta toner so as to be displaced by an extent corresponding to three dots (approximately 126.9 μm) toward the left side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region A (second region) contiguous to the sub-region B (second region), thereby forming still another second mark TM2.

Thus in the outermost sub-region A, the magenta lines are arranged with a displacement by an extent corresponding to three dots (approximately 126.9 μm) to the left side from the black lines. As a result, either of the magenta and black lines is arranged at every sixth dots so that this sub-region A looks faraway in eyes the same color tone (density) as the outermost sub-region G where the magenta lines are arranged with displacement by three dots toward the right side from the black lines.

And, in the sub-region B, the magenta lines are arranged with a displacement by an extent corresponding to two dots (approximately 84.6 μm) to the left side from the black lines, and in the sub-region F, the magenta lines are arranged with a displacement by two dots (approximately 84.6 μm) toward the right side from the black lines. Because they are identical with each other in size of unprinted area of the original color of the recording paper, the sub-regions B and F faraway look the same color tone (density) in eyes.

Likewise, in the sub-region C, the magenta lines are arranged with a displacement by an extent corresponding to a single dot (approximately 42.3 μm) to the left side from the black lines, and in the sub-region E, the magenta lines are arranged with a displacement by a single dot (approximately 42.3 μm) toward the right side from the black lines. Because they are identical with each other in size of unprinted area of the original color of the recording paper, the sub-regions C and E faraway look the same color tone (density) in eyes.

A cyan test-pattern image and a yellow test-pattern image are printed in the manner discussed in connection with the magenta test-pattern image.

The positional error detecting method using this test-pattern image T2 is identical with that of the first embodiment, so its description is omitted here.

According to the modified image forming apparatus and the modified test-pattern image forming method of the second embodiment, partly because each of the first and second color lines is a longitudinal line extending in the secondary scanning direction (the recording paper conveyance direction), and partly because the test-pattern image T2 composed of the first and second marks TM1, TM2 contains a transverse succession of portions of the longitudinal black lines and extends continuously from the scanning-start-side marginal portion to the scanning-end-side marginal portion in the primary scanning direction, it is possible to judge a change in the primary scanning direction in the positional error extent in the primary scanning direction precisely in terms of the positional error in the secondary scanning direction of the individual mark as the test-pattern image T2 with the second color lines TL2 displaced in the primary scanning direction is observed by eyes for shipment of the printer at a factory or for maintenance, inspection or repairing of the printer at user's site by the customer engineer (CE). As a result, it is possible to grasp a change in the primary scanning direction in extent of positional error in the primary scanning direction so that the customer engineer can discriminate whether or not there have occurred a staggering pitch of the exposure device or an positioning error of the exposure device, which can be assumed as a cause for the change in the primary scanning direction in extent of positional error in the primary scanning direction (uneven printing in the primary scanning direction) Then the customer engineer performs exchange of parts and mechanical adjustments of positions of parts exactly and efficiently.

For example, if the test-pattern image T2 has been shifted as a whole in the primary scanning direction perpendicular to the recording paper conveyance direction, it indicates that the exposure device has presumably been mounted off the correct position in the primary scanning direction. In such event, the customer engineer copes with the trouble by correcting the position of the exposure device or by inputting position error information (positional error extent due to the transverse shift) on the operation panel for address conversion to correct the positional error by the address conversion section based on the position error information.

Otherwise if the test-pattern image T2 has not been shifted as a whole in the primary scanning direction but has encountered a positional error in the primary scanning direction, it indicates that there has presumably occurred a staggering pitch of the exposure device. In this case, the customer engineer can cope with this trouble by exchanging the exposure device with a new one.

Further, because a combination of test-pattern images, including a cyan test-pattern image, which is composed of black lines and cyan lines, a magenta test-pattern image, which is composed of black lines and magenta lines, a yellow test-pattern image, which is composed of black lines and yellow lines, are formed in series arrangement in the secondary scanning direction, the customer engineer can grasps the position error for each and every color easily and efficiently. Further, since black (K), which is the most contrastive with the whole recording paper (printing sheet) among four colors, i.e. yellow (Y), magenta (M), cyan (C) and black (K), is selected as a reference color of the test-pattern image, the customer engineer can grasps the positional error more easily.

Another modified image forming apparatus and another modified test-pattern image forming method according to a third embodiment of the present invention will now be described with reference to FIG. 12.

The modified image forming apparatus of the third embodiment is identical in the basic form of test-pattern image data with that of the first embodiment, and is different therefrom in that lines of the individual colors composing a test-pattern image T3 are longitudinal lines.

Figure 12:
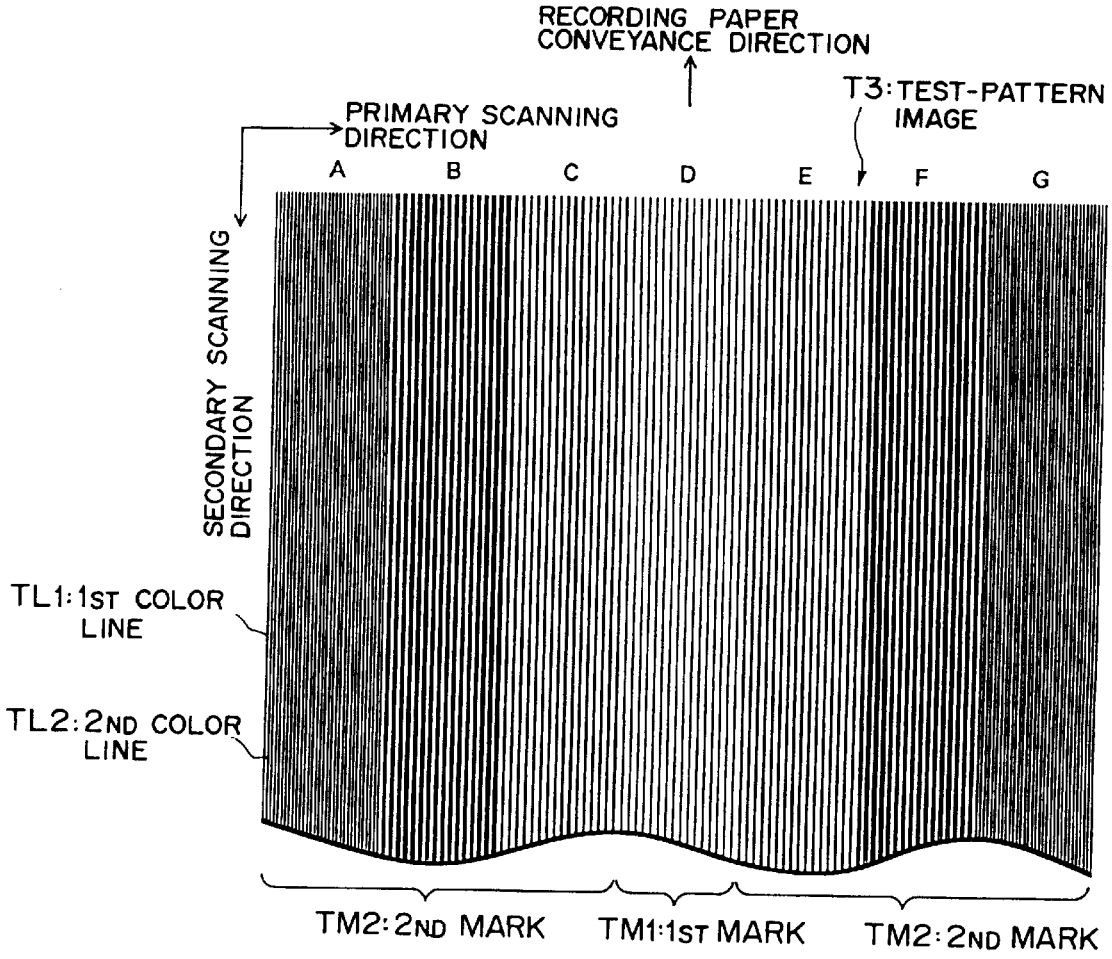
FIG. 12 is a fragmentary, enlarged diagram of another alternative test-pattern image printed by an image forming apparatus according to a third embodiment of the present invention, showing the line arrangement of the test-pattern image.

Specifically, in the third embodiment, the test-pattern image T3, which is to be formed by executing print control for electrostatic recording units 24-1 through 24-4 by a test-pattern image forming control unit 100, is composed by black lines as the first color lines TL1, and cyan lines, magenta lines and yellow lines as the second color lines TL2, each color line being a longitudinal line extending in the recording paper conveyance direction as shown in FIG. 12. The details of this test-pattern image T3 will be described later.

And the test-pattern image T3 composed of first and second marks TM1, TM2 contains a transverse succession of portions of longitudinal black lines (first color lines) TL1, and extends continuously from the scanning-start-side to the scanning-end-side on the recording paper in the secondary scanning direction (FIG. 7), each portion being a full length of the individual black line.

The length of the test-pattern image T3 extending in the recording paper conveyance direction is preferably longer than the circumferential length (e.g., approximately 94.5 mm (30π)) if the electrostatic recording units 24-1 through 24-4 used as the plural image forming units are equipped with the respective photosensitive drums 32-1 through 32-4. As the result, possible positional errors occurring for every cycle of rotation of the individual photosensitive drums 32-1 through 32-4 periodically appear in the test-pattern image T3 as printed, the custom engineer can comfortably grasp that a drive-gear-attachment flange associated with the photosensitive drum 32-1 through 32-4 is presumably inclined posture off the correct posture, by simply observing the printed test-pattern image T3 by eyes.

For this purpose, in the third embodiment, likewise the first embodiment, the black-dedicated electrostatic recording unit (black-dedicated image forming unit) 24-4 for forming a black image is used as the first image forming unit for forming the first color lines TL1. And the yellow-dedicated electrostatic recording unit (yellow-dedicated image forming unit) 24-1 for forming a yellow image, the magenta-dedicated electrostatic recording unit (magenta-dedicated image forming unit) 24-2 for forming a magenta image, and the cyan-dedicated electrostatic recording unit (cyan-dedicated image forming unit) 24-3 for forming a cyan image, are used as second image forming units for forming second color lines TL2.

And the test-pattern image forming control unit 100 controls the black-dedicated electrostatic recording unit 24-4, as the first image forming unit, and the yellow-, magenta- and cyan-dedicated electrostatic recording units 24-1, 24-2, 24-4, as the second image forming units, so as to form a combination of test-pattern images composed of a magenta test-pattern image, which is composed of black lines (first color lines) TL1 and magenta lines (second color lines) TL2, a cyan test-pattern image, which is composed of black lines TL1 and cyan lines (second color lines) TL2, and a yellow test-pattern image, which is composed of black lines TL1 and yellow lines (second color lines) TL2, which test-pattern images are arranged in series in the primary scanning direction.

The remaining construction of the third embodiment is identical with that of the first embodiment, so its description is omitted here.

FIG. 12 shows, on enlarged scale, a fragment of the magenta test-pattern image as one example of test-pattern image T3. This test-pattern image T3 is an illustrative test-pattern image printed using a full-color printer whose pitch is 600 dpi (approximately 42.3 μm pitch) In this test-pattern image T3, a plurality of longitudinal lines (extending throughout seven sub-regions A through G, which are arranged in transverse sequence in the primary scanning direction), each having a predetermined line width (e.g., a single dot width), are drawn at every predetermined period (e.g., 6-dot period (approximately 254 μm pitch)) using black (K) toner as the first color; this is, plurality of black lines, each having a predetermined line width, are arranged at a predetermined pitch (e.g., 6-dot period (approximately 254 μm pitch)) Further, the region where the plural black lines are arranged is divided into a plurality of sub-regions, i.e. seven sub-regions A through G, which are arranged in transverse sequence (in the primary scanning direction). Within these seven sub-regions A through G, marks (first and second marks TM1, TM2) different in density are formed in a manner described later. Thus these seven marks are formed in longitudinal strips, and hence the test-pattern image T3 is formed as a test-pattern image composed of seven strip-shaped marks. The transverse width (the strip width, or the width in the primary scanning direction) of each of the sub-regions A through G may be set at option, preferably approximately 110-dot width (approximately 693 μm)

In the sub-region D occupying a central part of the seven sub-regions, a transverse succession of longitudinal lines (magenta lines extending throughout the sub-region D), each having a predetermined line width (e.g., a single dot width), at a predetermined pitch (e.g., 6-dot period (approximately 254 μm pitch)) are drawn in magenta toner so as to overlap with black lines, which are drawn in black toner. As a result, a plurality of magenta lines, each having the same line width as that of the black lines (e.g., a single dot width), are arranged at the same pitch as that of the black lines (e.g., 6-dot period (approximately 254 μm pitch)) so as to overlap with the black lines within the sub-region D (first region) occupying central part of all the sub-regions A through G where the plural black lines are arranged, thereby forming a first mark TM1.

And in the sub-region E (second region) contiguous to the central sub-region D on the right side, a transverse succession of portions of longitudinal lines (magenta lines extending throughout the sub-region E), each having a predetermined line width (e.g., a single dot width), at a predetermined pitch (e.g., 6-dot period (approximately 254 μm pitch)) are drawn in magenta toner so as to be displaced by an extent corresponding to a single dot (approximately 42.3 μm) toward the scanning-end-side in the primary scanning direction (right side in FIG. 12) with respect to the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region E (second region) contiguous to the central sub-region D (first region), thereby forming a second mark TM2.

Likewise, in the sub-region C (second region) contiguous to the central sub-region D on the left side, a transverse succession of portions of longitudinal lines (magenta lines extending throughout the sub-region C), each having a predetermined line width (e.g., a single dot width), are drawn in magenta toner so as to be displaced by an extent corresponding to a single dot (approximately 42.3 μm) toward the scanning-start-side on the recording paper in the primary scanning direction (left side in FIG. 10) from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region C (second region) contiguous to the central sub-region D (first region), thereby forming another second mark TM2.

And in the sub-region F (second region) contiguous to the sub-region E on the right side, a transverse succession of portions of longitudinal lines (magenta lines extending throughout the sub-region F), each having a predetermined line width (e.g., a single dot width), are drawn in magenta toner so as to be displaced by an extent corresponding to two dots (approximately 84.6 μm) toward the right side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region F (second region) contiguous to the sub-region E (second region), thereby forming still another second mark TM2.

Likewise, in the sub-region B (second region) contiguous to the sub-region C on the left side, a transverse succession of portions of longitudinal lines (magenta lines extending throughout the sub-region B), each having a predetermined line width (e.g., a single dot width), are drawn in magenta toner so as to be displaced by an extent corresponding to two dots (approximately 84.6 μm) toward the left side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region B (second region) contiguous to the sub-region C (second region), thereby forming an addition second mark TM2.

Further, in the sub-region G (second region, the outermost sub-region) contiguous to the sub-region F on the right side, a transverse succession of portions of longitudinal lines (magenta lines extending throughout the sub-region G), each having a predetermined line width (e.g., a single dot width), are drawn in magenta toner so as to be displaced by an extent corresponding to three dots (approximately 126.9 μm) toward the right side in the primary scanning direction from the black lines. As a result, a plurality of magenta lines, each having the same line width as that of the black lines (e.g. a single dot width), are arranged at the same pitch as that of the black lines (e.g., 6-dot period (approximately 254 μm pitch)) so as to be displaced in a direction perpendicular to the black lines within the outermost sub-region G (second region) contiguous to the sub-region F (second region), thereby forming a further second mark TM2.

Likewise, in the sub-region A (second region, the outermost sub-region) contiguous to the sub-region B on the left side, a transverse succession of portions of longitudinal lines (magenta lines extending throughout the sub-region A), each having a predetermined line width (e.g., a single dot width), are drawn in magenta toner so as to be displaced by an extent corresponding to three dots (approximately 126.9 μm) toward the left side in the primary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region A (second region) contiguous to the sub-region B (second region), thereby forming still another second mark TM2.

Thus in the outermost sub-region A, the magenta lines are arranged with a displacement by an extent corresponding to three dots (approximately 126.9 μm) to the left side from the black lines. As a result, either of the magenta and black lines is arranged at every sixth dots so that this sub-region A looks faraway in eyes the same color tone (density) as the outermost sub-region G where the magenta lines are arranged with displacement by three dots toward the right side from the black lines.

And, in the sub-region B, the magenta lines are arranged with a displacement by an extent corresponding to two dots (approximately 84.6 μm) to the left side from the black lines, and in the sub-region F, the magenta lines are arranged with a displacement by two dots (approximately 84.6 μm) toward the right side from the black lines. Because they are identical with each other in size of unprinted area of the original color of the recording paper, the sub-regions B and F faraway look the same color tone (density) in eyes is Likewise, in the sub-region C, the, magenta lines are arranged with a displacement by an extent corresponding to a single dot (approximately 42.3 μm) to the left side from the black lines, and in the sub-region E, the magenta lines are arranged with a displacement by a single dot (approximately 42.3 μm) toward the right side from the black lines. Because they are identical with each other in size of unprinted area of the original color of the recording paper, the sub-regions C and E faraway look the same color tone (density) in eyes.

A cyan test-pattern image and a yellow test-pattern image are printed in the manner discussed in connection with the magenta test-pattern image.

The positional error detecting method using this test-pattern image T3 is identical with that of the first embodiment, so its description is omitted here.

Also the method for forming this test-pattern image T3 by the image forming apparatus of the third embodiment is identical with that of the first embodiment, so its description is omitted here.

According to the modified image forming apparatus and the modified test-pattern image forming method of the third embodiment, partly because each of the first and second color lines is a longitudinal line extending in the secondary scanning direction (the recording paper conveyance direction), and partly because the test-pattern image T3 composed of the first and second marks TM1, TM2 contains a transverse succession of portions of the longitudinal black lines and extends continuously from the scanning-start-side marginal portion to the scanning-end-side marginal portion in the secondary scanning direction, it is possible to judge a change in the secondary scanning direction in the positional error extent in the primary scanning direction (uneven printing in the secondary scanning direction; for example, uneven printing looks meandering) precisely in terms of the positional error in the primary scanning direction of the individual mark as the test-pattern image T3 with the second color lines TL2 displaced in the primary scanning direction is observed by eyes for shipment of the printer at a factory or for maintenance, inspection or repairing of the printer at user's site by the customer engineer (CE). As a result, it is possible to grasp a change in the secondary scanning direction in extent of positional error in the primary scanning direction so that the customer engineer can discriminate whether or not there have occurred a staggering movement of the conveyor belt or an inclined posture of the drive-gear-attachment flange associated with the photosensitive drum, which would presumably a cause for the change in the secondary scanning direction in extent of positional error in the primary scanning direction. And the customer engineer can perform exchange of parts and mechanical adjustments of positions of parts exactly and efficiently.

In this case, the custom engineer can cope with this meandering movement of the conveyor belt 12 by exchanging the conveyor-belt unit 11. When it is judged that the drive-gear-attachment flange is inclined, the custom engineer can cope with this trouble by exchanging the electrostatic recording unit (print unit) 24-1 through 24-4.

Particularly, the electrostatic recording units 24-1 through 24-4 each equipped with a photosensitive drum for a different color are used as the respective image forming units. With this arrangement, by forming the test-pattern image T3 so as to have a length larger than the circumferential length of the photosensitive drum 32-1 through 32-4 equipped with the first and second image forming units, it is possible to exactly recognize an inclined posture of the drive-gear-attachment flange associated with the photosensitive drum 32-1 through 32-4.

Further, because a combination of test-pattern images, including a cyan test-pattern image, which is composed of black lines and cyan lines, a magenta test-pattern image, which is composed of black lines and magenta lines, a yellow test-pattern image, which is composed of black lines and yellow lines, are formed in series arrangement in the primary scanning direction, the customer engineer can grasps the position error for each and every color easily and efficiently. Further, since black (K), which is the most contrastive with the whole recording paper (printing sheet) among four colors, i.e. yellow (Y), magenta (M), cyan (C) and black (K), is selected as a reference color of the test-pattern image T3, the customer engineer can grasps the positional error more easily.

Still another modified image forming apparatus and another modified test-pattern image forming method according to a fourth embodiment of the present invention will now be described with reference to FIG. 13.

The modified image forming apparatus of the fourth embodiment is identical in the basic form of test-pattern image data with that of the first embodiment, and is different therefrom in that lines of the individual colors composing a test-pattern image T4 are transverse lines extending in the primary scanning direction.

Figure 13:
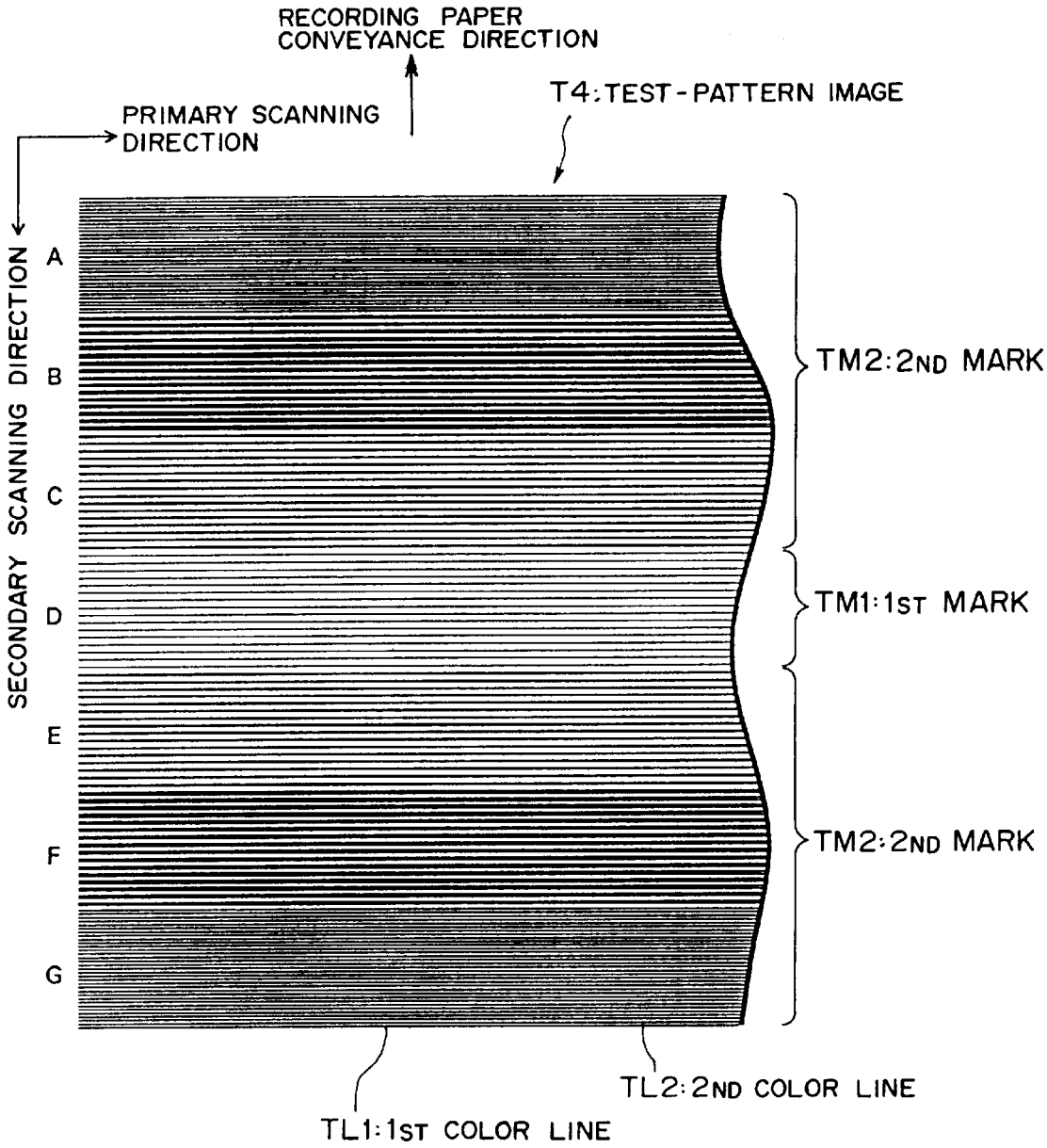
FIG. 13 is a fragmentary, enlarged diagram of still another alternative test-pattern image printed by an image forming apparatus according to a fourth embodiment of the present invention, showing the line arrangement of the test-pattern image.

Specifically, in the fourth embodiment, the test-pattern image T4, which is to be formed by executing print control for electrostatic recording units 24-1 through 24-4 by a test-pattern image forming control unit 100, is composed by black lines as the first color lines TL1, and cyan lines, magenta lines and yellow lines as the second color lines TL2, each color line being a transverse line extending in the primary scanning direction perpendicular to the recording paper conveyance direction as shown in FIG. 13. The details of this test-pattern image T4 will be described later.

And the test-pattern image T4 composed of first and second marks TM1, TM2 contains a longitudinal succession of portions of transverse black lines (first color lines) TL1, each group being coextensive with the black lines, and extends continuously from the scanning-start-side to the scanning-end-side on the recording paper in the primary scanning direction perpendicular to the recording paper conveyance direction (likewise in FIG. 11), each portion being a full length of the individual black line. Alternatively, the test-pattern image T4 may be formed on the recording paper only at a scanning-start-side marginal region and a scanning-end-side marginal region in the primary scanning direction.

For this purpose, in the fourth embodiment, likewise the first embodiment, the black-dedicated electrostatic recording unit (black-dedicated image forming unit) 24-4 for forming a black image is used as the first image forming unit for forming the first color lines TL1. And the yellow-dedicated electrostatic recording unit (yellow-dedicated image forming unit) 24-1 for forming a yellow image, the magenta-dedicated electrostatic recording unit (magenta-dedicated image forming unit) 24-2 for forming a magenta image, and the cyan-dedicated electrostatic recording unit (cyan-dedicated image forming unit) 24-3 for forming a cyan image, are used as second image forming units for forming second color lines TL2.

And the test-pattern image forming control unit 100 controls the black-dedicated electrostatic recording unit 24-4, as the first image forming unit, and the yellow-, magenta- and cyan-dedicated electrostatic recording units 24-1, 242, 24-3, as the second image forming units, so as to form a combination of test-pattern images composed of a magenta test-pattern image, which is composed of black lines (first color lines) TL1 and magenta lines (second color lines) TL2, a cyan test-pattern image, which is composed of black lines TL1 and cyan lines (second color lines) TL2, and a yellow test-pattern image, which is composed of black lines TL1 and yellow lines (second color lines) TL2, which test-pattern images are arranged in series in the secondary scanning direction.

The remaining construction of the fourth embodiment is identical with that of the first embodiment, so its description is omitted here.

FIG. 13 shows, on enlarged scale, a fragment of the magenta test-pattern image as one example of test-pattern image T4. This test-pattern image T4 is an illustrative test-pattern image printed using a full-color printer whose pitch is 600 dpi (approximately 42.3 $\mu$m pitch).

In this test-pattern image T4, a plurality of transverse lines (extending throughout seven sub-regions A through G, which are arranged in longitudinal sequence in the secondary scanning direction), each having a predetermined line width (e.g., a single dot width), are drawn at every predetermined period (e.g., 6-dot period (approximately 254 $\mu$m pitch)) using black (K) toner as the first color; this is, a plurality of, black lines, each having a predetermined line width, are arranged at a predetermined pitch (e.g., 6-dot period (approximately 254 $\mu$m pitch)) Further, the region where the plural black lines are arranged is divided into a plurality of sub-regions, i.e. seven sub-regions A through G, which are arranged in longitudinal sequence (in the secondary scanning direction). Within these seven sub-regions A through G, marks (first and second marks TM1, TM2) different in density are formed in a manner described later. Thus these seven marks are formed in transverses trips, and hence the test-pattern image T4 is formed as a test-pattern image T4 composed of seven strip-shaped marks. The longitudinal width (the strip width, or the width in the secondary scanning direction) of each of the sub-regions A through G may be set at option, preferably approximately 110-dot width (approximately 693 $\mu$m)

In the sub-region D occupying a central part of the seven sub-regions, a longitudinal succession of portions of transverse lines (magenta lines extending throughout the sub-region D), each having a predetermined line width (e.g., a single dot width), at a predetermined pitch (e.g., 6-dot period (approximately 254 $\mu$m pitch)) are drawn in magenta toner so as to overlap with black lines, which are drawn in black toner. As a result, a plurality of magenta lines, each having the same line width as that of the black lines (e.g., a single dot width), are arranged at the same pitch as that of the black lines (e.g., 6-dot period (approximately 254 μm pitch)) so as to overlap with the black lines within the sub-region D (first region) occupying central part of all the sub-regions A through G where the plural black lines are arranged, thereby forming a first mark TM1.

And in the sub-region E (second region) contiguous to the central sub-region D on the lower side, a longitudinal succession of portions of transverse lines (magenta lines extending throughout the sub-region E), each having a predetermined line width (e.g., a single dot width), at a predetermined pitch (e.g., 6-dot period (approximately 254 a m pitch)) are drawn in magenta toner so as to be displaced by an extent corresponding to a single dot (approximately 42.3 μm) toward the scanning-end-side in the secondary scanning direction (lower side in FIG. 13) with respect to the black lines. As a result, a plurality of magenta lines, each having the same line width as that of the black lines (e.g., a single dot width), are arranged at the same pitch as that of the black lines (e.g., 6-dot period (approximately 254 m pitch)) so as to be displaced in a direction perpendicular to the black lines within the sub-region E (second region) contiguous to the central sub-region D (first region), thereby forming a second mark TM2.

Likewise, in the sub-region C (second region) contiguous to the central sub-region D on the upper side, a longitudinal succession of portions of transverse lines (magenta lines extending throughout the sub-region C), each having a predetermined line width (e.g., a single dot width), are drawn in magenta toner so as to be displaced by an extent corresponding to a single dot (approximately 42.3 μm) toward the scanning-start-side on the recording paper in the secondary scanning direction (upper side in FIG. 13) from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region C (second region) contiguous to the central sub-region D (first region), thereby forming another second mark TM2.

And in the sub-region F (second region) contiguous to the sub-region E on the lower side, a longitudinal succession of portions of transverse lines (magenta lines extending throughout the sub-region F), each having a predetermined line width (e.g., a single dot width), are drawn in magenta toner so as to be displaced by an extent corresponding to two dots (approximately 84.6 μm) toward the lower side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region F (second region) contiguous to the sub-region E (second region), thereby forming still another second mark TM2.

Likewise, in the sub-region B (second region) contiguous to the sub-region Con the upper side, a longitudinal succession of portions of transverse lines (magenta lines extending throughout the sub-region B), each having a predetermined line width (e.g., a single dot width), are drawn in magenta toner so as to be displaced by an extent corresponding to two dots (approximately 84.6 μm) toward the upper side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the sub-region B (second region) contiguous to the sub-region C (second region), thereby forming an addition second mark TM2.

Further, in the sub-region G (second region, the outermost sub-region) contiguous to the sub-region F on the lower side, a longitudinal succession of portions of transverse lines (magenta lines extending throughout the sub-region G), each having a predetermined line width (e.g., a single dot width), are drawn in magenta toner so as to be displaced by an extent corresponding to three dots (approximately 126.9 μm) toward the lower side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region G (second region) contiguous to the sub-region F (second region), thereby forming a further second mark TM2.

Likewise, in the sub-region A (second region, the outermost sub-region) contiguous to the sub-region B on the upper side, a longitudinal succession of portions of transverse lines (magenta lines extending throughout the sub-region A), each having a predetermined line width (e.g., a single dot width), are drawn in magenta toner so as to be displaced by an extent corresponding to three dots (approximately 126.9 μm) toward the upper side in the secondary scanning direction from the black lines. As a result, a plurality of magenta lines, each having the same line width as that of the black lines (e.g., a single dot width), are arranged at the same pitch as that of the black lines (e.g., 6-dot period (approximately 254 μm pitch)) so as to be displaced in a direction perpendicular to the black lines within the outermost sub-region A (second region) contiguous to the sub-region B (second region), thereby forming still another second mark TM2.

Thus in the outermost sub-region A, the magenta lines are arranged with a displacement by an extent corresponding to three dots (approximately 126.9 μm) to the upper side from the black lines. As a result, either of the magenta and black lines is arranged at every sixth dots so that this sub-region A looks faraway in eyes the same color tone (density) as the outermost sub-region G where the magenta lines are arranged with displacement by three dots toward the lower side from the black lines.

And, in the sub-region B, the magenta lines are arranged with a displacement by an extent corresponding to two dots (approximately 84.6 μm) to the upper side from the black lines, and in the sub-region F, the magenta lines are arranged with a displacement by two dots (approximately 84.6 μm) toward the lower side from the black lines. Because they are identical with each other in size of unprinted area of the original color of the recording paper, the sub-regions B and F faraway look the same color tone (density) in eyes.

Likewise, in the sub-region C, the magenta lines are arranged with a displacement by an extent corresponding to a single dot (approximately 42.3 μm) to the upper side from the black lines, and in the sub-region E, the magenta lines are arranged with a displacement by a single dot (approximately 42.3 μm) toward the lower side from the black lines. Because they are identical with each other in size of unprinted area of the original color of the recording paper, the sub-regions C and E faraway look the same color tone (density) in eyes.

A cyan test-pattern image and a yellow test-pattern image are printed in the manner discussed in connection with the magenta test-pattern image.

The positional error detecting method using this test-pattern image T4 is identical with that of the first embodiment, so its description is omitted here.

Also the method for forming this test-pattern image T3 by the image forming apparatus of the fourth embodiment is identical with that of the first embodiment, so its description is omitted here.

According to the modified image forming apparatus and the modified test-pattern image forming method of the fourth embodiment, partly because each of the first and second color lines is a transverse line extending in the primary scanning direction perpendicular to the recording paper conveyance direction, and partly because the test-pattern image T4 composed of the first and second marks TM1, TM2 contains a longitudinal succession of full-length transverse groups of the transverse black lines, each group being coextensive with the black lines, and extends continuously from the scanning-start-side marginal portion to the scanning-end-side marginal portion in the primary scanning direction, it is possible to judge a change in the primary scanning direction in the positional error extent in the secondary scanning direction (uneven printing in the primary scanning direction;

for example, uneven printing looks curved) precisely in terms of the positional error of the individual mark in the secondary scanning direction as the test-pattern image T4 with the second color lines TL2 displaced in the secondary scanning direction is observed by eyes for shipment of the printer at a factory or for maintenance, inspection or repairing of the printer at user's site by the customer engineer (CE). As a result, it is possible to grasp a change in the primary scanning direction in extent of positional error in the secondary scanning direction so that the customer engineer can discriminate whether or not there have occurred non-parallel or curved scanning lines of the exposure device, which would presumably a cause for the change in the primary scanning direction in extent of positional error in the secondary scanning direction. And the customer engineer can perform exchange of parts and mechanical adjustments of positions of parts exactly and efficiently.

In this case, the custom engineer can cope with this curved scanning lines of the exposure device by exchanging the exposure device with a new one.

Further, because a combination of test-pattern images, including a cyan test-pattern image, which is composed of black lines and cyan lines, a magenta test-pattern image, which is composed of black lines and magenta lines, a yellow test-pattern image, which is composed of black lines and yellow lines, are formed in series arrangement in the secondary scanning direction, the customer engineer can grasps the position error for each and every color easily and efficiently. Further, since black (K), which is the most contrastive with the whole recording paper (printing sheet) among four colors, i.e. yellow (Y), magenta (M), cyan (C) and black (K), is selected as a reference color of the test-pattern image T4, the customer engineer can grasps the positional error more easily.

By forming the foregoing test-pattern image T4 of the fourth embodiment on the recording paper at at least the scanning-start-side marginal portion and the scanning-end-side marginal portion in the primary scanning direction perpendicular to the recording paper conveyance direction, it is possible to calculate a skew angle with respect to the recording paper conveyance direction (secondary scanning direction) using the positional error extent of the test-pattern image T4. Namely, by obtaining positional error extents in the secondary scanning direction for the individual test-pattern images formed at the scanning-start-side marginal portion and the scanning-end-side marginal portion in the primary scanning direction, it is possible to calculate an angular displacement between the test-pattern images, i.e., an skew angle corresponding to the angular displacement with respect to the secondary scanning direction.

If there has occurred a skew angle corresponding to the angular displacement with respect to the secondary scanning direction, the customer engineer can cope with the positional error by inputting instructions on the operation panel to correct when the image data is expanded on the image memories. Further, if such correction cannot to cope with, the customer engineer copes with it then by remounting the exposure device.

Figure 14:
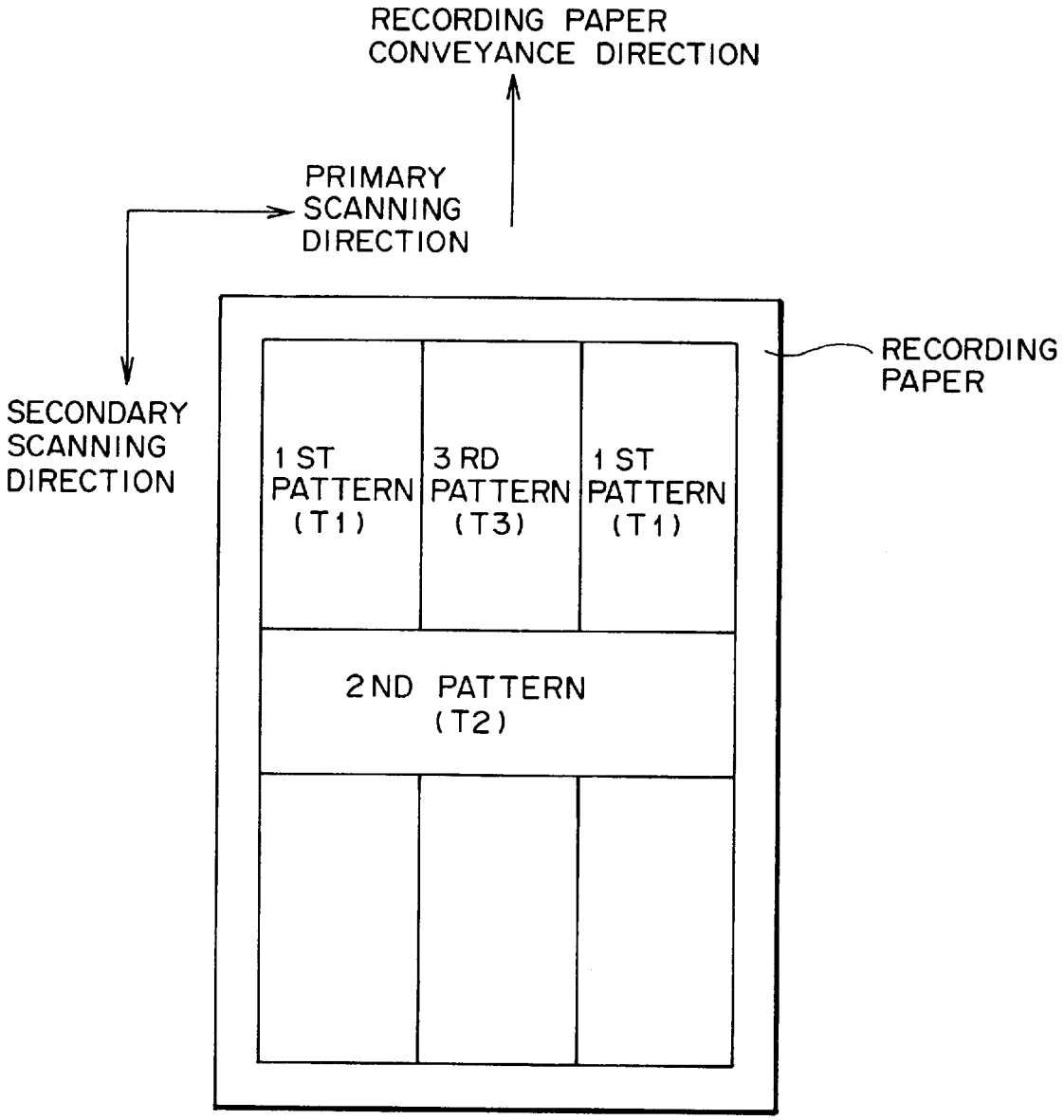
FIG. 14 is a diagram illustrating the arrangement of various test-pattern images printed on a single sheet of recording paper as a single composite test pattern by the respective image forming apparatuses according to the foregoing individual embodiments.

In the foregoing embodiments, different test-pattern images T1 through T4 are individually printed. Alternatively, as shown in FIG. 14, various kinds of test-pattern images may be printed on a single sheet of recording paper collectively.

Specifically, the test-pattern image T1 according to the first embodiment, as (1) a first pattern image composed of first and second marks TM1, TM2, which image contains a longitudinal succession of portions of transverse first color lines TL1 and are formed on the recording paper at at least the scanning-start-side marginal portion and the scanning-end-side marginal portion in the secondary scanning direction, the test-pattern image T2 according to the second embodiment, as (2) a second pattern image composed of first and second marks TM1, TM2, which image contains a transverse succession of portions of longitudinal first color lines TL1 and are formed on the recording paper at at least the scanning-start-side marginal portion and the scanning-end-side marginal portion in the primary scanning direction perpendicular to the recording paper conveyance direction, and the test-pattern image T3, as (3) a third pattern image composed of first and second marks TM1, TM2, which image contains a transverse succession of portions of longitudinal first color lines TL1 and are formed on the recording paper continuously from the scanning-start-side to the scanning-end-side in the secondary scanning direction, may be collectively printed on a single sheet of recording paper.

In this example, since the test-pattern image T1 of the first embodiment, i.e. the first pattern image, is formed on he recording paper at at least the scanning-start-side (upper side of the recording paper) and the scanning-end-side (lower side of the recording paper) in the second scanning direction, it is possible to judge, from comparison of these test pattern images T1, that the speed of rotation of the fixing roller 26 or the registration roller 20 is too fast or too slow.

And since the test-pattern image T2 of the second embodiment, i.e. the second pattern image, is formed on the recording paper at at least the scanning-start-side and the scanning-end-side in the primary scanning direction perpendicular to the recording paper conveyance direction, it is possible to judge the occurrence of a staggering inter-dot pitch of the exposure device or mis-positioning of the exposure device in the primary scanning direction.

Further, since the test-pattern image T3, of the third embodiment, i.e. the third pattern image, is formed on the recording paper continuously from the scanning-start-side to the scanning-end-side in the secondary scanning direction, it is possible to judge the occurrence of a meandering movement of the conveyor belt 12.

If a plurality of test-pattern images, i.e. the first, second and third pattern images, are collectively printed on a single sheet of recording paper, the customer engineer can concurrently judge more than one cause for positional errors when shipping the printer from a factory or when repairing and inspection of the printer at user's site. For the same reason, it is possible to judge more than one cause for position errors efficiently, without spending recording paper and toner more than necessary.

Although the test-pattern image T4 of the fourth embodiment also could be printed together with the foregoing test-pattern images T1, T2, T3 on a single sheet of recording paper, the test-pattern image T4, unlike the first, second and third pattern images T1, T2, T3, does not serve in nature to judge positional errors occurring with lapse of time using a full-color printer. Therefore it is preferable to print this test-pattern image T4 separately as demand arises.

In each of the foregoing embodiments, the test-pattern image forming program is stored in the MPU 72 of the controller 62 for controlling a plurality of image forming units to form the test-pattern images T1 through T4 in accordance with the program. Alternatively, the test-pattern image forming program may be stored in a computer-readable recording medium, such as CD-ROM, CD-R, optical disc, magneto-optical disc (MO), floppy disc, magnetic tape, non-volatile memory card, and may install the program in the image forming apparatus to form the test-pattern image for maintenance or inspection purpose. This test-pattern image forming program may be stored in a recording medium, such as a hard disc or ROM, of a personal computer 92.

The test-pattern image forming program includes:

first data serving to arrange a plurality of black lines (first color lines) TL1, each having a predetermined line width (e.g., a single dot width), at a predetermined pitch (e.g., 6-dot period (approximately 254 $\mu$m pitch)) by the black dedicated electrostatic recording unit (first color image forming unit) 24-4;

second data serving to form a first mark TM1 by arranging a plurality of magenta, cyan or yellow lines (second color lines) TL2, each having a line width equal to that of the individual black line TL1, at a pitch equal to that of the black lines TL1 by the magenta-, cyan- or yellow-dedicated electrostatic recording unit (second color image forming unit) 24-1, 24-2, 24-3 so as to overlap with the black lines TL1 within a first region occupying part of an area where the black lines TL1 are arranged; and third data serving to form a second mark TM2 by displacing a plurality of magenta, cyan or yellow lines (second color lines) TL2 in a direction perpendicular to the black lines TL1 within a second region contiguous to the first region and by arranging the magenta, cyan or yellow lines TL2, each having a line width equal to that of the individual black line TL1, at a pitch equal to that of the black lines TL1 by the magenta-, cyan- or yellow-dedicated electrostatic recording unit (second-color image forming unit) 24-1, 24-2, 24-3.

This program gives instructions to a computer to control the individual electrostatic recording units (image forming units) 24-1 through 24-4 based on the test-pattern image data composed of the first, second and third data.

In each of the foregoing illustrated embodiments, the test-pattern images T1, T2, T3, T4 are formed with black (k) selected as a reference color as black is most contractive and hence serves to assist in judgment. Alternatively, another color (e.g., cyan, magenta or yellow) may be selected as a reference color.

Further, in the foregoing illustrated embodiments, the central sub-regions D of the plural sub-regions A–G composing the test-pattern images T1 through T4 is lowest in density, and the density gradually increases toward the outer sub-regions. The difference of density between the individual sub-regions A–G may gradually vary in an alternative manner; for example, one outermost sub-region A or G may have the lowest density as the density may gradually increase toward the other outermost sub-region G or A. And in these illustrated embodiments, the test-pattern image is divided into 7 sub-regions; but the number of sub-regions should by no means be limited to 7.

Furthermore, in the foregoing illustrated embodiments, the present invention is applied to a full-color printer that performs full-color printing using 4 color toners. In an alternative form, the present invention may be applied to color printing using 3 color toners (e.g., red, green and blue) and also to other printing machines using more than four different color toners.

In each of the foregoing embodiments, the present invention is applied to an electrophotographic color printer, which serves as an image forming apparatus. But the present invention may be also applied to an alternative type image forming apparatus, such as an ink jet type color printer.

In addition, in these illustrated embodiments, the test-pattern image forming control unit 100 forms a cyan test-pattern image, a magenta test-pattern image and a yellow test-pattern image in parallel arrangement. Alternatively, this test-pattern image forming control unit 100 may control the black-, magenta-, cyan- and yellow-dedicated image forming units in such a manner that at least one of a magenta test-pattern image composed of black lines and magenta lines, a cyan test-pattern image composed of black lines and cyan lines, and a yellow test-pattern image composed of black lines and yellow lines is formed as a test-pattern image.

Accordingly, by forming only the test-pattern image needed for grasping the occurrence of a positional error, the customer engineer can recognize the positional error efficiently. And given that the test-pattern image is formed with black, which is most contractive, selected as a reference color, the customer engineer can recognize the position error with increased efficiency.

The image forming apparatus, the test-pattern image forming program storing recording medium, the test-pattern image forming method, and the skew angle calculating method, all according to the present invention, should by no means be limited to the illustrated examples. In the present invention, various other changes or modifications may be suggested without departing the gist of the invention.

What is claimed is:

1. An image forming apparatus comprising:

a plurality of image forming units for forming different color images on recording paper, said plural image forming units including a first color image forming unit for forming a first color image, and at least one second color image forming unit for forming a second color image; and test-pattern image forming control means for controlling said first and second image forming units to form a test-pattern image composed of first and second marks different in density, which are arranged adjacent to one another without any gap therein between, based on test-pattern image data that includes first data serving to arrange a plurality of first color lines, each having a predetermined line width, at a predetermined pitch by said first color image forming unit, second data serving to form said first mark by arranging a plurality of second color lines, each having a line width equal to that of the individual first color line, at a pitch equal to that of said first color lines by said at least one second color image forming unit so as to overlap with said first color lines within a first region occupying part of an area where said plural first color lines are arranged, and third data serving to form said second mark by displacing a plurality of second color lines in a direction perpendicular to said first color lines within a second region contiguous to said first region and by arranging said second color lines, each having a line width equal to that of the individual first color line, at a pitch equal to that of said first color lines by said at least one second color image forming unit; and each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at least at scanning-start- and scanning-end-side marginal regions in the secondary scanning direction.

2. An image forming apparatus according to claim 1, wherein:

said second region is composed of a plurality of sub-regions;

said third data is data serving to form a plurality of second marks, which are different in density from one another, by varying the extent of displacement of said second color lines from said first color lines in said plural sub-regions of said second region stepwise; and said test-pattern image forming control means controls said first and second image forming units to form said test-pattern image such that said first mark and said plural second marks are disposed adjacent to one another as they are different in density from one another.

3. An image forming apparatus according to claim 1, wherein:

said predetermined line width is equal to the size of a single dot;

said second region is composed of a plurality of sub-regions;

said third data is data serving to form a plurality of second marks of different densities by varying the extent of displacement of said second color lines from said first color lines in said plural sub-regions of said second region stepwise one dot for every sub-region; and said test-pattern image forming control means controls said first and second image forming units to form said test-pattern image such that said first mark and said plural second marks are disposed adjacent to one another as they are different in density from one another.

4. An image forming apparatus according to claim 1, wherein:

said first image forming unit is a black-dedicated image forming unit for forming black lines as said first color lines;

said at least one second image forming unit includes a magenta-dedicated image forming unit for forming magenta lines as said second color lines, a cyan-dedicated image forming unit for forming cyan lines as said second color lines, and a yellow-dedicated image forming unit for forming yellow lines as said second color lines; and said test-pattern image forming control means controls said black-, magenta-, cyan- and yellow-dedicated image forming units in such a manner that at least one of a cyan test-pattern image composed of said black and cyan lines, a magenta test-pattern image composed of said black and magenta lines, and a yellow test-pattern image composed of said black and yellow lines, is formed as said test-pattern image.

5. An image forming apparatus according to claim 1, wherein:

each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper continuously from a scanning-start-side marginal region to a scanning-end-side marginal region in the secondary scanning direction.

6. An image forming apparatus according to claim 1, wherein:

each of said plural image forming units is an electrostatic recording unit equipped with a photosensitive drum;

each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper so as to extend in a secondary scanning direction by a length longer than a circumferential length of said photosensitive drum associated with the respective one of said first and second image forming units.

7. An image forming apparatus according to claim 1, wherein:

said first image forming unit is a black-dedicated image forming unit for forming black lines as said first color lines;

said at least one second image forming unit includes a magenta-dedicated image forming unit for forming magenta lines as said second color lines, a cyan-dedicated image forming unit for forming cyan lines as said second color lines, and a yellow-dedicated image forming unit for forming yellow lines as said second color lines; and said test-pattern image forming control means controls said black-, magenta-, cyan- and yellow-dedicated image forming units in such a manner that a cyan test-pattern image composed of said black and cyan lines, a magenta test-pattern image composed of said black and magenta lines, and a yellow test-pattern image composed of said black and yellow lines, are formed in a series arrangement in said primary scanning direction as a single test-pattern image combination.

8. An image forming apparatus comprising:

a plurality of image forming units for forming different color images on recording paper, said plural image forming units including a first color image forming unit for forming a first color image, and at least one second color image forming unit for forming a second color image; and test-pattern image forming control means for controlling said first and second image forming units to form a test-pattern image composed of first and second marks different in density, which are arranged adjacent to one another without any gap therein between, based on test-pattern image data that includes:

first data serving to arrange a plurality of first color lines, each having a predetermined line width, at a predetermined pitch by said first color image forming unit, second data serving to form said first mark by arranging a plurality of second color lines, each having a line width equal to that of the individual first color line, at a pitch equal to that of said first color lines by said at least one second color image forming unit so as to overlap with said first color lines within a first region occupying part of an area where said plural first color lines are arranged, and third data serving to form said second mark by displacing a plurality of second color lines in a direction perpendicular to said first color lines within a second region contiguous to said first region and by arranging said second color lines, each having a line width equal to that of the individual first color line, at a pitch equal to that of said first color lines by said at least one second color image forming unit; and each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at least at scanning-start- and scanning-end-side marginal regions in the secondary scanning direction, wherein:

each of said first and second color lines is a longitudinal line extending in a direction of conveyance of the recording paper; and said test-pattern image composed of said first and second marks contains a transverse succession of portions of said plural first color lines extending longitudinally and is formed on the recording paper at at least scanning-start- and scanning-end-side marginal regions in the primary scanning direction.

9. An image forming apparatus according to claim 8, wherein:

each of said first and second color lines is a longitudinal line extending in a direction of conveyance of the recording paper; and said test-pattern image composed of said first and second marks contains a transverse succession of portions of said plural first color lines extending longitudinally and is formed on the recording paper continuously from a scanning-start-side marginal region to a scanning-end-side marginal region in the primary scanning direction.

10. An image forming apparatus according to claim 8, wherein:

said first image forming unit is a black-dedicated image forming unit for forming black lines as said first color lines;

said at least one second image forming unit-includes a magenta-dedicated image forming unit for forming magenta lines as said second color lines, a cyan-dedicated image forming unit for forming cyan lines as said second color lines, and a yellow-dedicated image forming unit for forming yellow lines as said second color lines; and said test-pattern image forming control means controls said black-, magenta-, cyan- and yellow-dedicated image forming units in such a manner that a cyan test-pattern image of said black and cyan lines, a magenta test-pattern image of said black and magenta lines, and a yellow test-pattern image of said black and yellow lines, are formed in a series arrangement in the secondary scanning direction as a single test-pattern image combination.

11. An image forming apparatus comprising:

a plurality of image forming units for forming different color images on recording paper, said plural image forming units including a first color image forming unit for forming a first color image, and at least one second color image forming unit for forming a second color image; and test-pattern image forming control means for controlling said first and second image forming units to form a test-pattern image composed of first and second marks different in density, which are arranged adjacent to one another without any gap therein between, based on test-pattern image data that includes:

first data serving to arrange a plurality of first color lines, each having a predetermined line width, at a predetermined pitch by said first color image forming unit, second data serving to form said first mark by arranging a plurality of second color lines, each having a line width equal to that of the individual first color line, at a pitch equal to that of said first color lines by said at least one second color image forming unit so as to overlap with said first color lines within a first region occupying part of an area where said plural first color lines are arranged, and third data serving to form said second mark by displacing a plurality of second color lines in a direction perpendicular to said first color lines within a second region contiguous to said first region and by arranging said second color lines, each having a line width equal to that of the individual first color line, at a pitch equal to that of said first color lines by said at least one second color image forming unit; and each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at least at scanning-start- and scanning-end-side marginal regions in the secondary scanning direction, wherein:

each of said first and second color lines is a longitudinal line extending in a direction of conveyance of the recording paper; and said test-pattern image composed of said first and second marks contains a transverse succession of portions of said plural first color lines extending longitudinally and is formed on the recording paper continuously from a scanning-start-side marginal region to a scanning-end-side marginal region in the secondary scanning direction.

12. An image forming apparatus according to claim 11, wherein:

each of said plural image forming units is an electrostatic recording unit equipped with a photosensitive drum;

each of said first and second color lines is a longitudinal line extending in a direction of conveyance of the recording paper; and said test-pattern image composed of said first and second marks contains a transverse succession of portions of said plural first color lines extending longitudinally and is formed so as to extend in a secondary scanning direction by a length longer than a circumferential length of said photosensitive drum associated with the respective one of said first and second image forming units.

13. An image forming apparatus comprising:

a plurality of image forming units for forming different color images on recording paper, said plural image forming units including a first color image forming unit for forming a first color image, and at least one second color image forming unit for forming a second color image; and test-pattern image forming control means for controlling said first and second image forming units to form a test-pattern image composed of first and second marks different in density, which are arranged adjacent to one another without any gap therein between, based on test-pattern image data that includes:

first data serving to arrange a plurality of first color lines, each having a predetermined line width, at a predetermined pitch by said first color image forming unit, second data serving to form said first mark by arranging a plurality of second color lines, each having a line width equal to that of the individual first color line, at a pitch equal to that of said first color lines by said at least one second color image forming unit so as to overlap with said first color lines within a first region occupying part of an area where said plural first color lines are arranged, and third data serving to form said second mark by displacing a plurality of second color lines in a direction perpendicular to said first color lines within a second region contiguous to said first region and by arranging said second color lines, each having a line width equal to that of the individual first color line, at a pitch equal to that of said first color lines by said at least one second color image forming unit; and each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at least at scanning-start- and scanning-end-side marginal regions in the secondary scanning direction, wherein:

each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at at least a scanning-start-side marginal region and a scanning-end-side marginal region in said primary scanning direction.

14. An image forming apparatus according to claim 13, wherein:

each of said first and second color lines is a transverse line extending in a primary scanning direction perpendicular to a direction of conveyance of the recording paper; and said test-pattern image composed of said first and second marks contains a longitudinal succession of portions of said plural first color lines and is formed continuously from a scanning-start-side marginal region to a scanning-end-side marginal region in the primary scanning direction.

15. An image forming apparatus comprising:

a plurality of image forming units for forming different color images on recording paper, said plural image forming units including a first color image forming unit for forming a first color image, and at least one second color image forming unit for forming a second color image; and test-pattern image forming control means for controlling said first and second image forming units to form a test-pattern image composed of first and second marks different in density, which are arranged adjacent to one another without any gap therein between, based on test-pattern image data that includes:

first data serving to arrange a plurality of first color lines, each having a predetermined line width, at a predetermined pitch by said first color image forming unit, second data serving to form said first mark by arranging a plurality of second color lines, each having a line width equal to that of the individual first color line, at a pitch equal to that of said first color lines by said at least one second color image forming unit so as to overlap with said first color lines within a first region occupying part of an area where said plural first color lines are arranged, and third data serving to form said second mark by displacing a plurality of second color lines in a direction perpendicular to said first color lines within a second region contiguous to said first region and by arranging said second color lines, each having a line width equal to that of the individual first color line, at a pitch equal to that of said first color lines by said at least one second color image forming unit; and each of said first and second color lines is a transverse line extending in a primary scanning direction perpendicular to a direction of conveyance of the recording paper; and said test-pattern image composed of said first and second marks contains a longitudinal succession of portions of said plural first color lines extending transversely and is formed on the recording paper at least at scanning-start- and scanning-end-side marginal regions in the secondary scanning direction, wherein said test-pattern image is a composite form of a plurality of pattern images to be formed on a single sheet of the recording paper, said plural pattern images including:

a first pattern image in which each of said first and second color lines is a transverse line extending in a primary scanning direction perpendicular to the direction of conveyance of the recording paper, said first pattern image being composed of said first and second marks, containing a longitudinal succession of portions of said plural first color lines and being formed on the recording paper at at least a scanning-start-side marginal region and a scanning-end-side marginal region in a secondary scanning direction perpendicular to the primary scanning direction;

a second pattern image in which each of the first and second color lines is a longitudinal line extending in the direction of conveyance of the recording paper, said second pattern image being composed of said first and second marks, containing a transverse succession of portions of said plural first color lines and being formed on the recording paper at at least a scanning-start-side marginal region and a scanning-end-side marginal region in the primary scanning direction; and a third pattern image in which each of the first and second color lines is a longitudinal line extending in the direction of conveyance of the recording paper, said third pattern image being composed of said first and second marks, containing a transverse succession of portions of said plural first color lines and being formed on the recording paper continuously from a scanning-start-side marginal region to a scanning-end-side marginal region in the secondary scanning direction.

16. A skew angle calculation method for calculating a skew angle based on forming a test pattern image on a recording paper, comprising the steps of:

(a) forming the test-pattern image composed of first and second marks of different in densities, which marks are arranged adjacent to one another and are formed on a recording paper at least at a scanning-start-side marginal region and a scanning-end-side marginal region in a primary scanning direction perpendicular to the direction of conveyance of the recording paper, (a1) said first mark being formed on the recording paper by arranging a plurality of first color lines, each having a predetermined line width, at a predetermined pitch, and arranging a plurality of second color lines, each having a line width equal to that of the individual first color line, at a pitch equal to that of said first color lines so as to overlap with said first color lines within a first region occupying part of an area where said plural first color lines are arranged;

(a2) said second mark being formed on the recording paper by displacing a plurality of second color lines in a direction perpendicular to said first color lines within a second region contiguous to said first region, and by arranging said second color lines, each having a line width equal to that of the individual first color line, at a pitch equal to that of said first color lines, and (a3) said first and second marks being formed on the recording paper at least at a scanning-start-side marginal region and a scanning-end-side marginal region in a primary scanning direction perpendicular to the direction of conveyance of the recording paper; and (b) calculating the skew angle using the extents of displacement of the individual test-pattern images on said recording paper.

* * * * *